US005579865A

United States Patent [19]

Butler et al.

[11] Patent Number: 5,579,865

[45] Date of Patent: Dec. 3, 1996

[54] SCAFFOLD

[76] Inventors: J. Frank Butler, 13714 Bluff Cir., San Antonio, Tex. 78216; Robert J. Leach, 8423 Honiley, San Antonio, Tex. 78250

[21] Appl. No.: 200,394

[22] Filed: Feb. 23, 1994

(Under 37 CFR 1.47)

[51] Int. Cl.[6] ..... E04G 1/20

[52] U.S. Cl. ..... 182/141; 182/146

[58] Field of Search ..... 182/141, 142, 182/145, 150, 133, 146, 148, 130, 131

[56] References Cited

U.S. PATENT DOCUMENTS 3,937,301 2/1976 Bertail ..... 182/141 X
4,293,054 10/1981 Pieri .
4,498,556 2/1985 Garton .
4,589,520 5/1986 Tapfer ..... 182/63
4,809,814 3/1989 St-Germain .
5,259,479 11/1993 St-Germain .

FOREIGN PATENT DOCUMENTS 012091 7/1992 WIPO ..... 182/141

*Primary Examiner*—Alvin C. Chin-Shue
*Attorney, Agent, or Firm*—Akin, Gump, Strauss, Hauer & Feld, L.L.P.

[57] ABSTRACT

A modular scaffolding assembly in which the platform may move up or down in a continuous motion. A platform carriage is engaged with a tower by spring loaded friction blocks and climbs or descends the tower along a pair of stepped racks. Platform modules may be removably connected to the platform carriage.

13 Claims, 23 Drawing Sheets

SCAFFOLD

BACKGROUND OF THE INVENTION

The present invention relates to a scaffold. More particularly, the present invention provides a modular scaffolding assembly in which a platform may be moved up or down in a continuous motion.

Scaffolds are typically utilized by workers in the construction, repair, or cleaning of a building or other structure. Scaffolds permit the workers to access various levels of the building or other structure for purposes of raising or lowering building materials and equipment, as well as for permitting the workers to work on the building or structure.

SUMMARY OF THE INVENTION

The present invention provides a modular scaffolding assembly in which the platform may move up or down in a continuous motion. A platform carriage is engaged with a tower by spring loaded friction blocks and climbs or descends the tower along a pair of stepped racks. Platform modules may be removably connected to the platform carriage.

The scaffold of the present invention comprises a tower mounted to a base and a platform engaged with the tower. The platform comprises a platform carriage slidably engaged with corner tracks on the tower. A single phase electric motor drives two hydraulic pumps, the first pump powering an upper lift cylinder and a lower tilt cylinder and the second pump powering a lower lift cylinder and an upper tilt cylinder. The lift cylinders are systematically engaged with racks connected to the tower. The lift cylinders are connected to a yoke assembly which lifts the platform carriage. Proximity sensors signal solenoid valves to extend or retract to provide upward or downward movement of the platform in a continuous manner.

The method for raising the scaffold platform comprises the steps of (a) engaging the platform with the tower, (b) engaging the lower cylinder with a first step of the tower racks and extending the lower cylinder while simultaneously retracting the upper cylinder, (c) engaging the upper cylinder with a second step of the racks for a time interval while the lower cylinder is engaged with the first step and thereafter extending the upper cylinder while simultaneously retracting the lower cylinder, and repeating the foregoing steps (b) and (c) until the scaffold platform is raised to the desired height. The method for lowering the scaffold platform comprises the steps of (a) engaging the platform with the tower, (b) retracting the upper cylinder, (c) disengaging the lower cylinder from a first step and thereafter extending the lower cylinder and engaging the lower cylinder with a second step, (d) retracting the lower cylinder, and (e) disengaging the upper cylinder from the racks and thereafter extending the upper cylinder and reengaging the upper cylinder with a third step. The foregoing steps (b), (c), (d), and (e) are repeated until the scaffold platform is lowered to a desired height.

DETAILED DESCRIPTION OF THE PREFERRED EMBODIMENT

Figure 1:
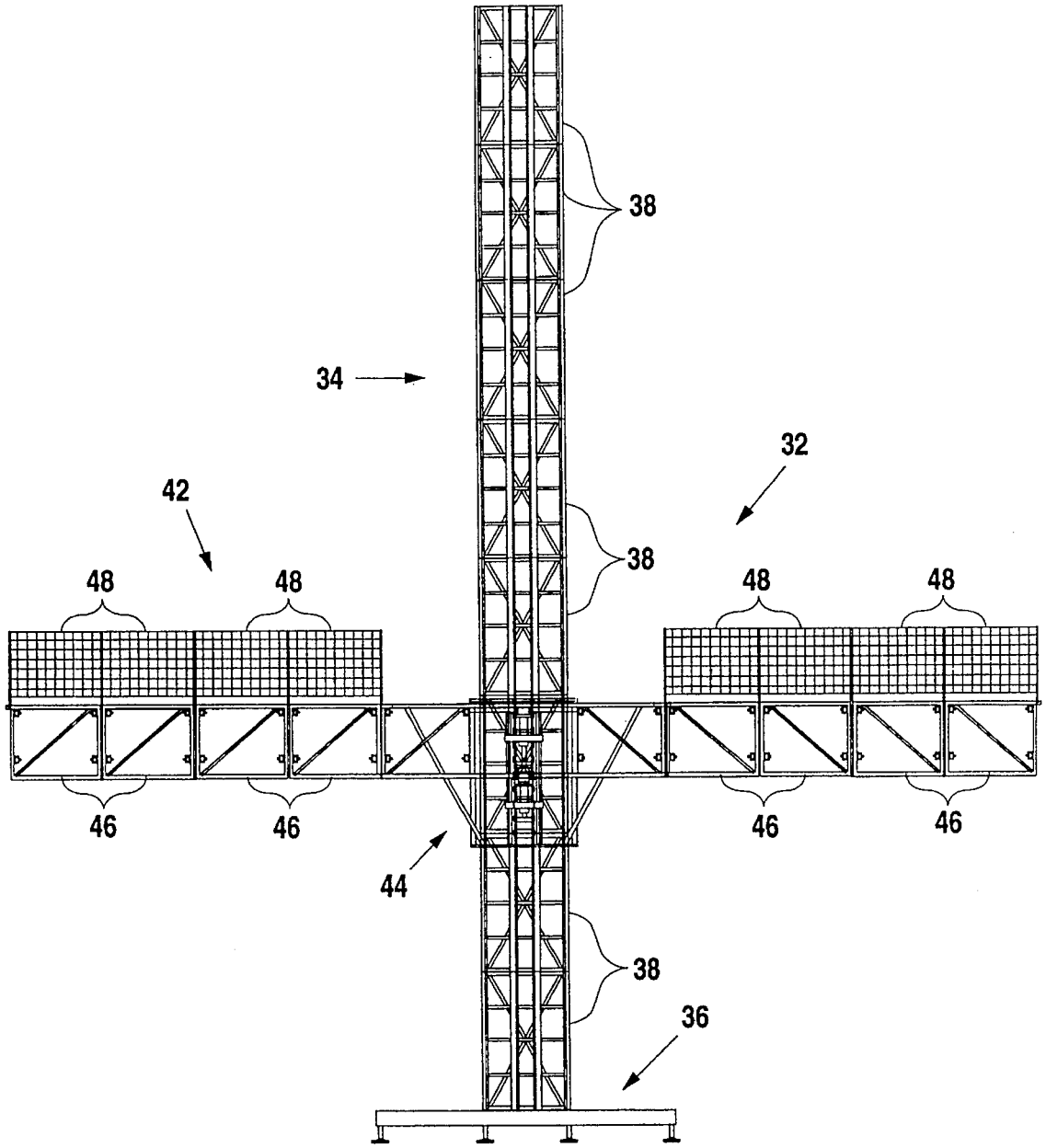
FIG. 1 is a front elevation view of the preferred embodiment of the scaffold of the present invention.

Referring to FIG. 1, the scaffold of the present invention is identified by the number 32. Scaffold 32 comprises a tower 34 which is mounted on a base 36. Tower 34 comprises a plurality of tower modules 38, the lowermost tower module 38 being welded to base 36 and each successive tower module 38 being bolted at each corner to an adjacent tower module 38 to form the height of tower 34. Tower module connection bolts (not shown) extend through bolt holes 40 illustrated in FIG. 8. Each tower module 38 has a height of approximately six feet (6'). Tower 34 is anchored to the building or other structure with which the scaffold 32 is utilized at intervals not to exceed twenty six feet (26') vertically.

Figure 2:
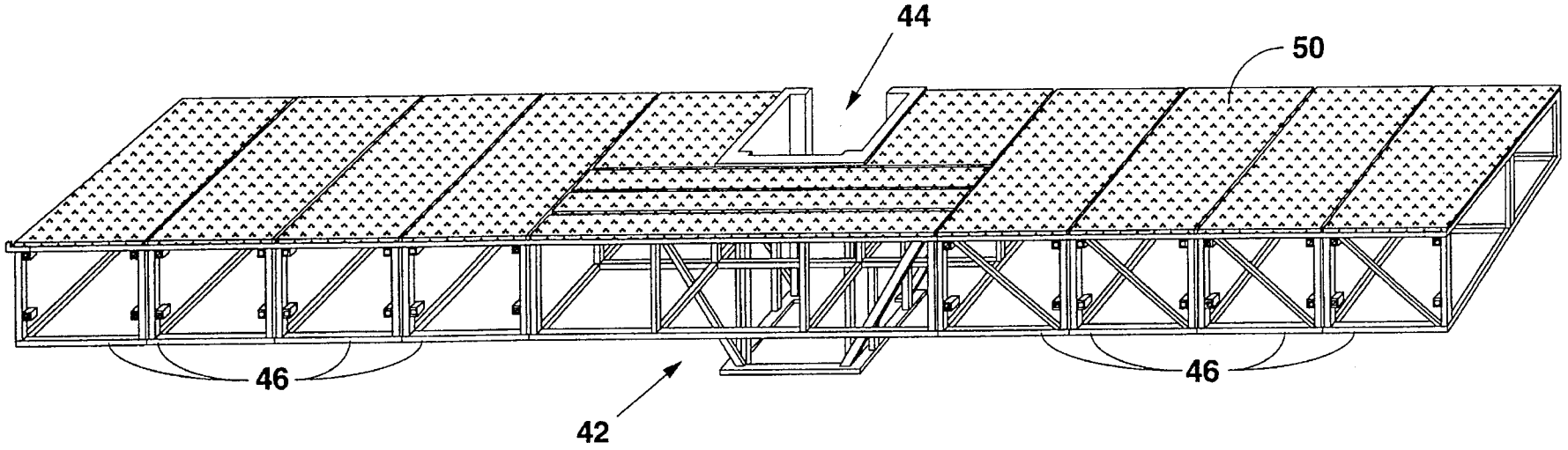
FIG. 2 is a perspective view of the platform in the preferred embodiment of the scaffold of the present invention.

Referring to FIG. 1 and FIG. 2, scaffold 32 further comprises a platform 42 which comprises a platform carriage 44 and a plurality of platform modules 46. As further described hereinbelow, each platform module 46 adjacent to platform carriage 44 is removably connected thereto and each subsequent platform module 46 is removably connected to each adjacent platform module 46. A platform guardrail 48 (not shown in FIG. 2) is connected to each platform module 46. A deck 50 is positioned on top of the carriage 44 and platform modules 46. Platform carriage 44 has a width of approximately twelve feet (12') and each platform module has a width of approximately four feet (4').

Figure 3:
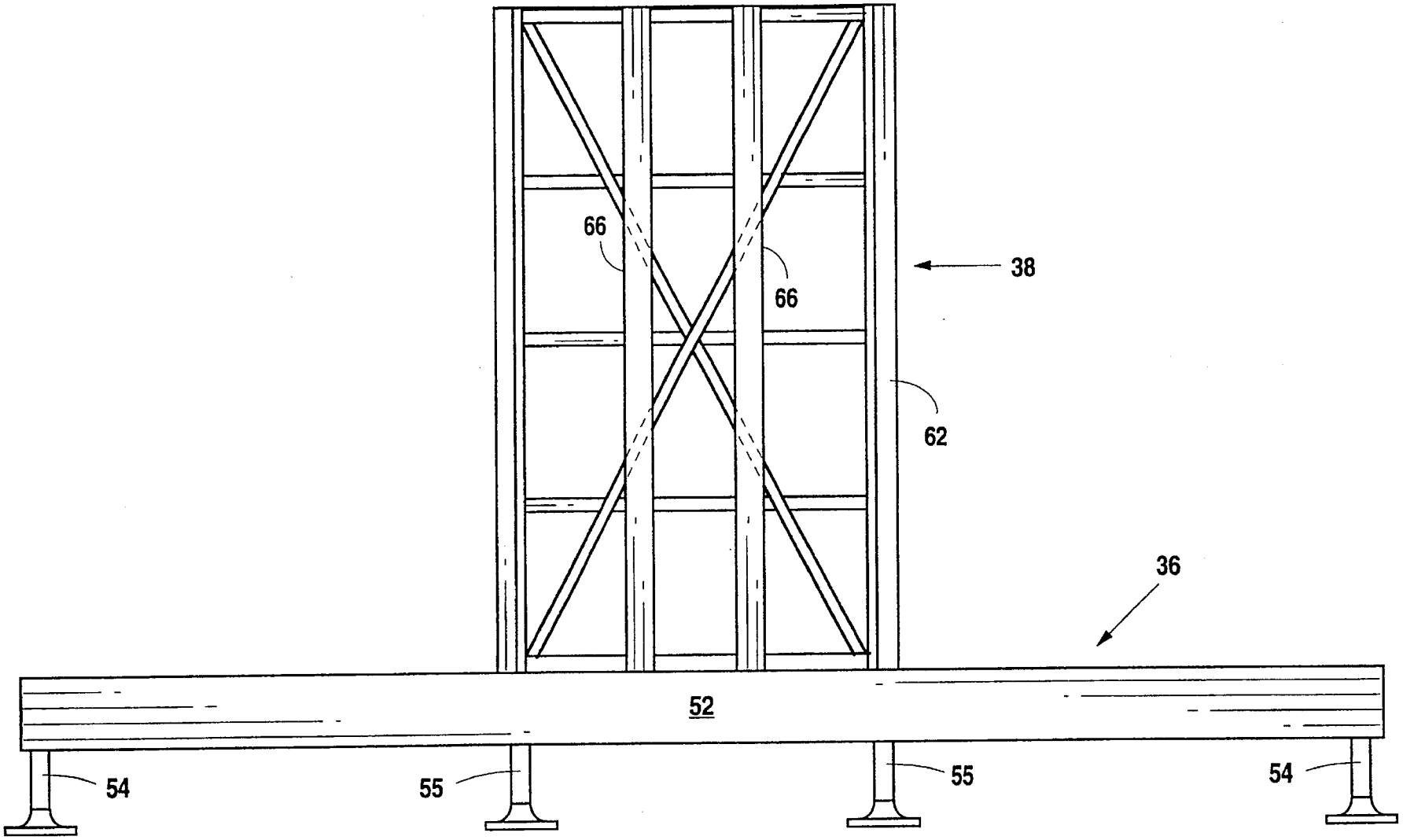
FIG. 3 is a front elevation view of the preferred embodiment of the scaffold of the present invention illustrating the base and a lowermost tower module.
Figure 5:
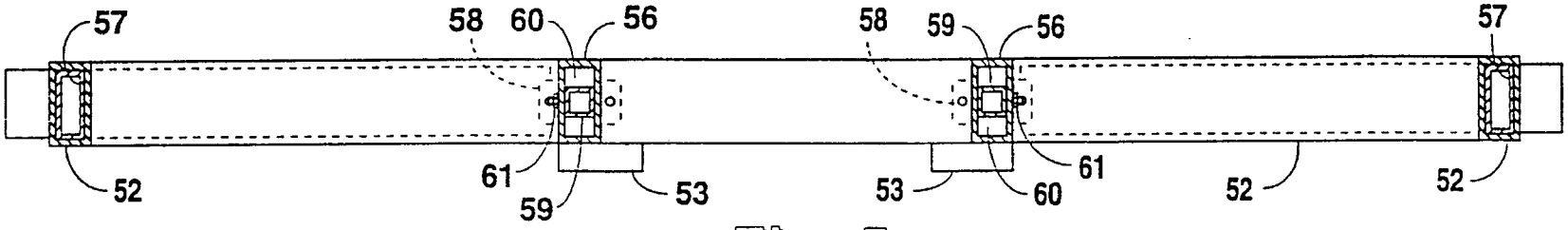
FIG. 5 is a cross sectional view taken along section lines 5—5 of FIG. 4 further illustrating components of the base.
Figure 4:
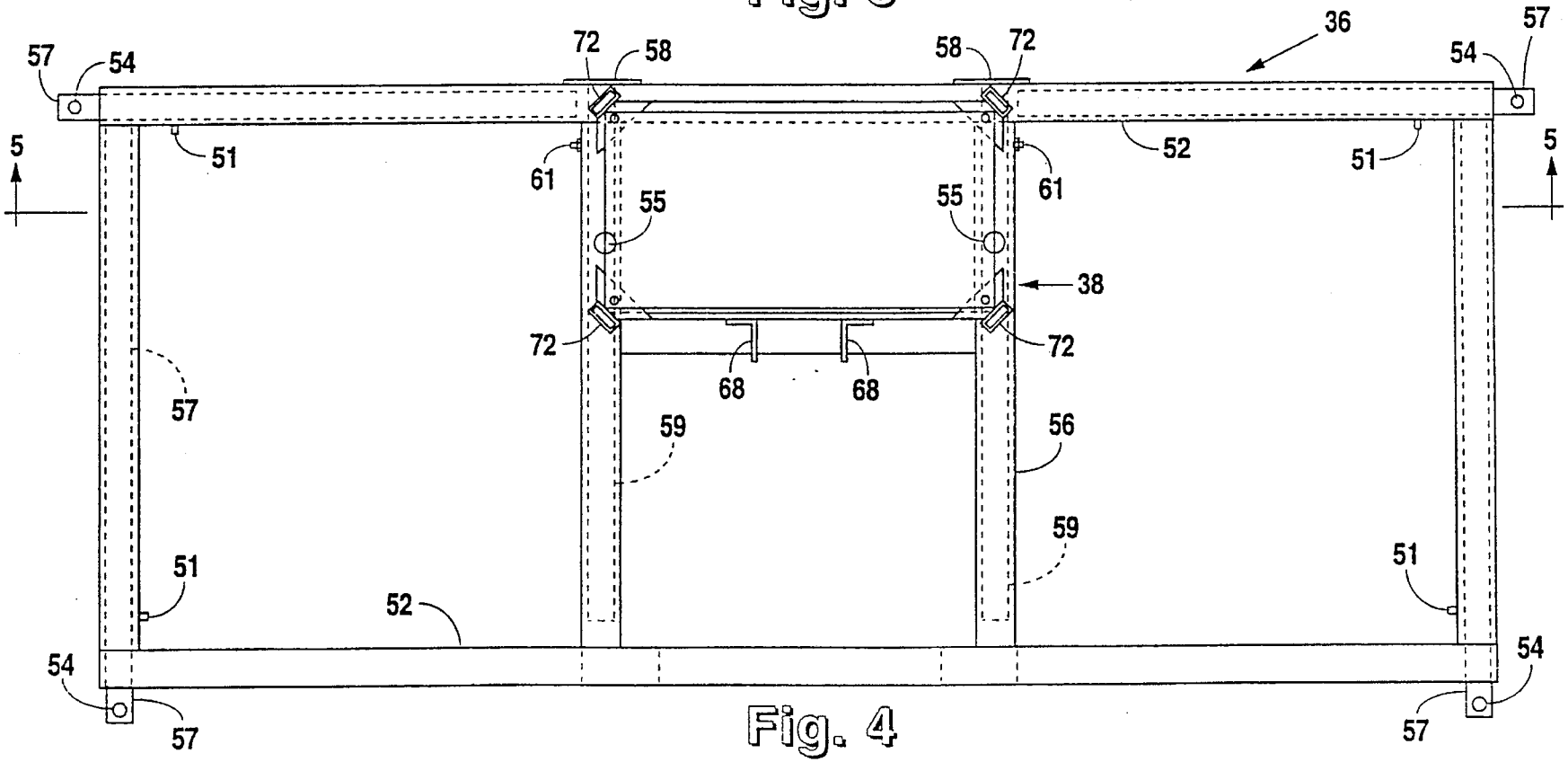
FIG. 4 is a top plan view of FIG. 3 illustrating the base and lowermost tower module.

Referring to FIGS. 3, 4, and 5, base 36 comprises a frame 52 which is supported by four (4) hydraulically operated leveling jacks 54 and a pair of load jacks 55. Frame 52 further comprises a pair of cross members 56 which assist in the support of a lowermost tower module 38. Base 36 further comprises a plurality of support arms 57 which are in telescopic engagement with frame 52. Each arm 57 may be secured in position by a keeper bolt 51 which extends through frame 52 and abuts against arm 57. Base 36 further comprises a pair of forklift boots 53 connected to frame 52 for positioning base 36. Leveling jacks 54 are mounted in arms 57 and load jacks 55 are mounted in cross members 56. Base 36 further comprises a pair of base anchor plates 58 which are each connected to a base anchor tube 59. Tubes 59 are in telescopic engagement within a passage 60 within cross members 56. Base 36 is anchored to the building or other structure with which scaffold 32 is utilized by sliding tubes 59 outward, bolting or otherwise securing anchor plates 58 to the building or other structure, and securing tubes 59 in position by keeper bolts 61, each of which may extend through a member 56 and press against an anchor tube 59.

Figure 6:
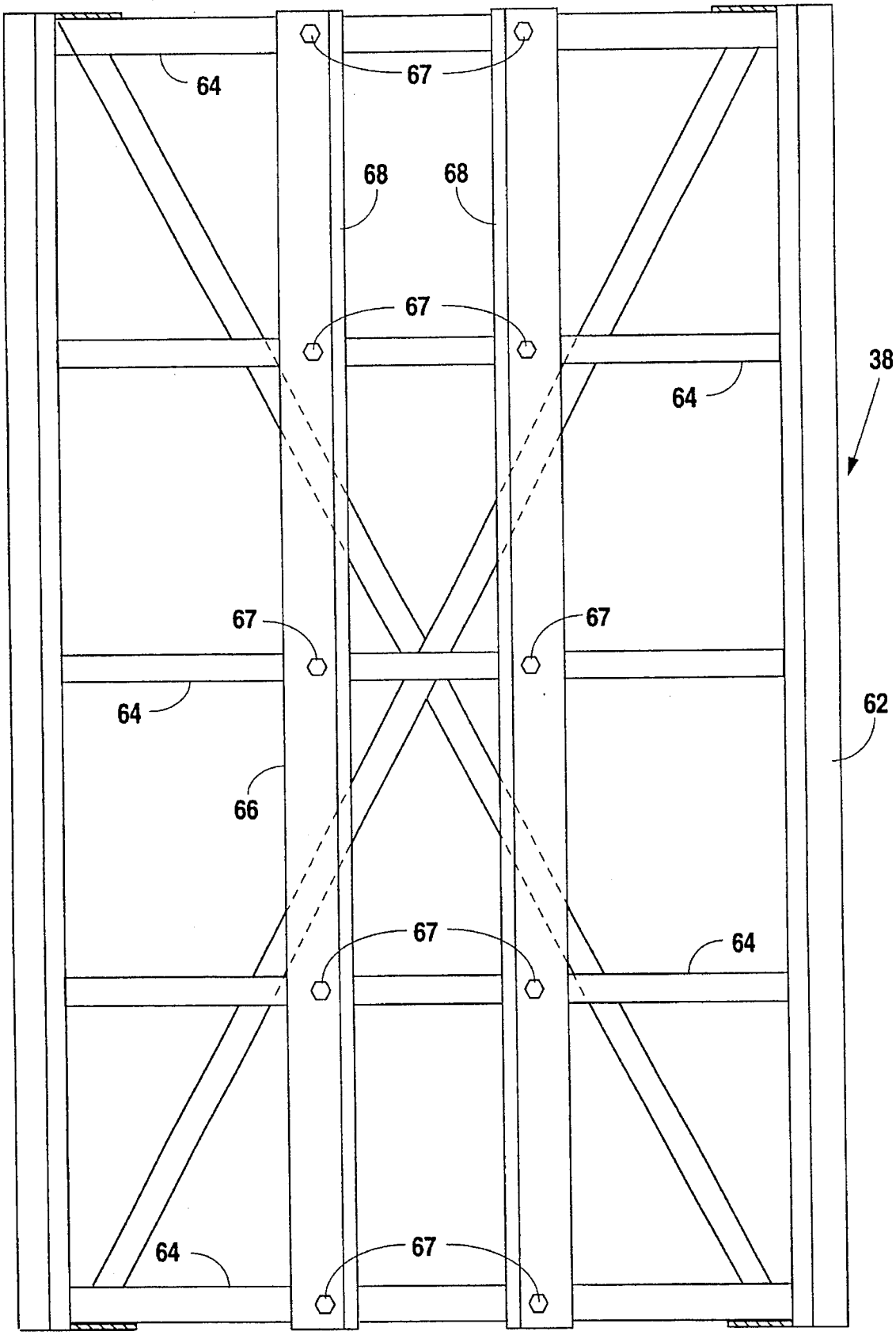
FIG. 6 is a front elevation view of a tower module.
Figure 7:
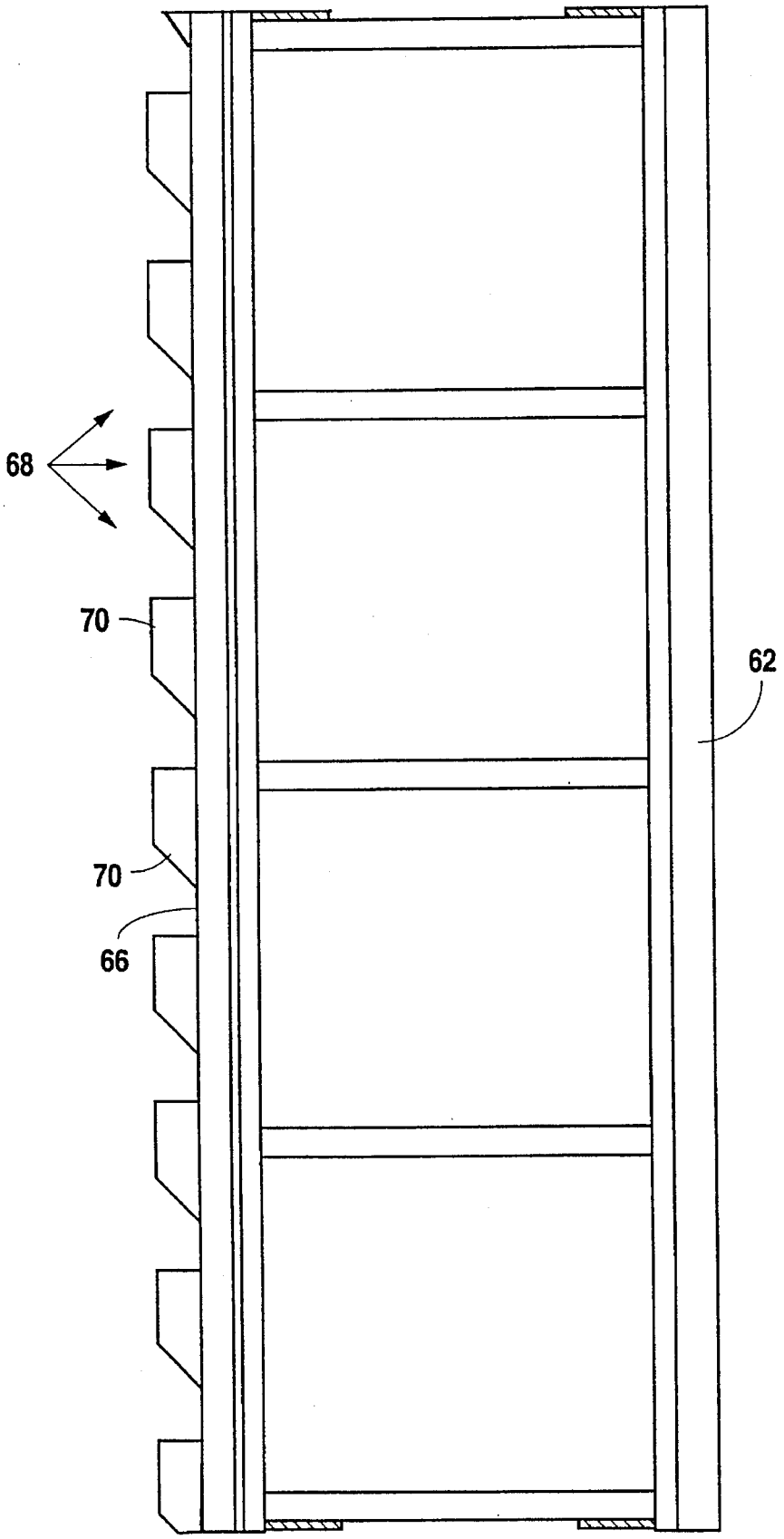
FIG. 7 is a side elevation view of a tower module.
Figure 8:
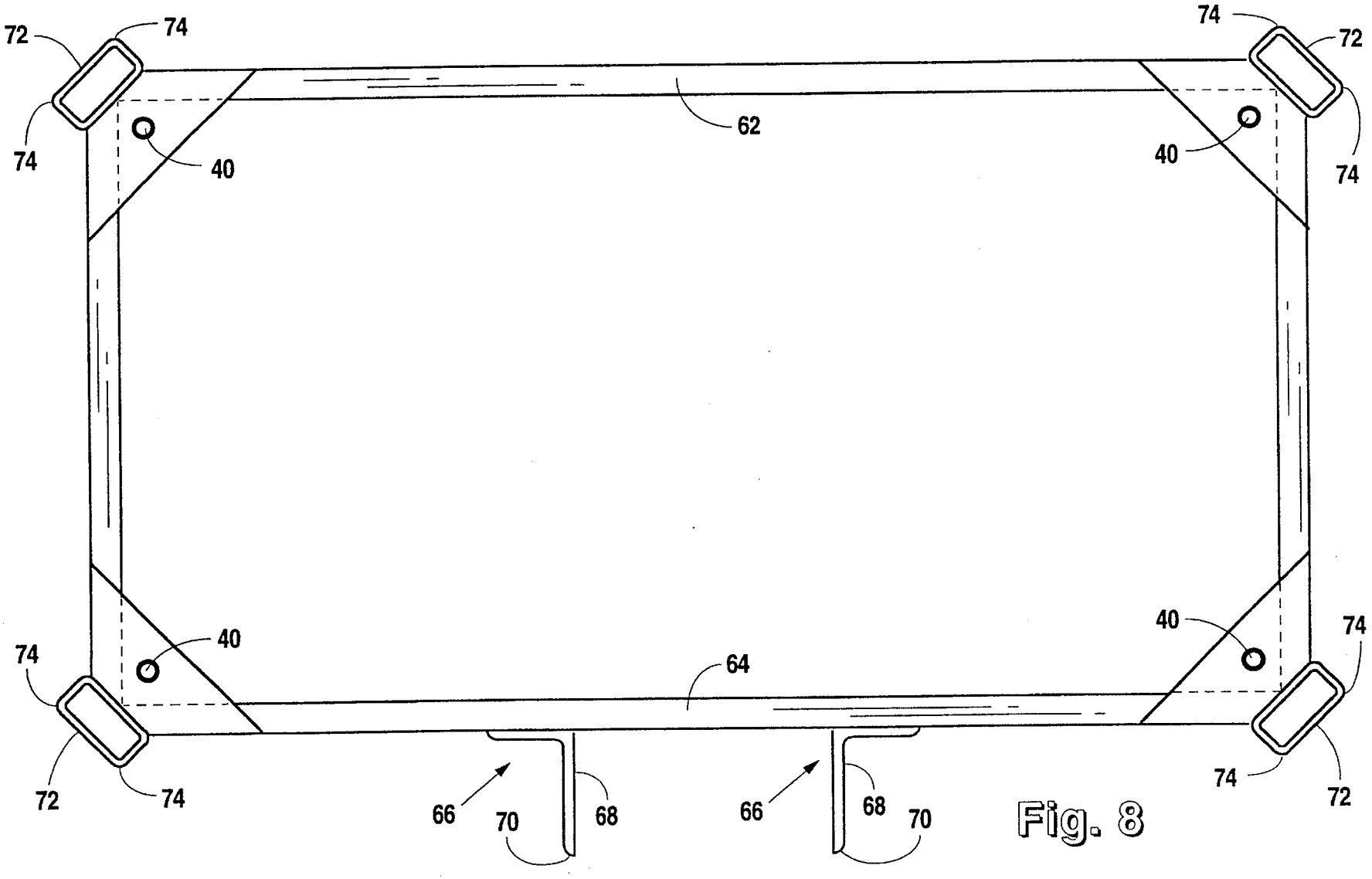
FIG. 8 is a top plan view of a tower module.

Referring to FIGS. 6, 7 and 8, each tower module 38 comprises a frame 62 having a plurality of generally horizontal cross members 64. A pair of racks 66 are bolted to cross members 64 by bolts 67 and each rack 66 comprises a plurality of steps 68, as further illustrated in FIG. 7. Steps 68 have an outermost edge 70. As illustrated in FIG. 8, each tower module 38 further comprises a plurality of tubular corner members 72 connected to frame 62, each corner member 72 having a pair of generally V-shaped or right angle edges or tracks 74.

Figure 9:
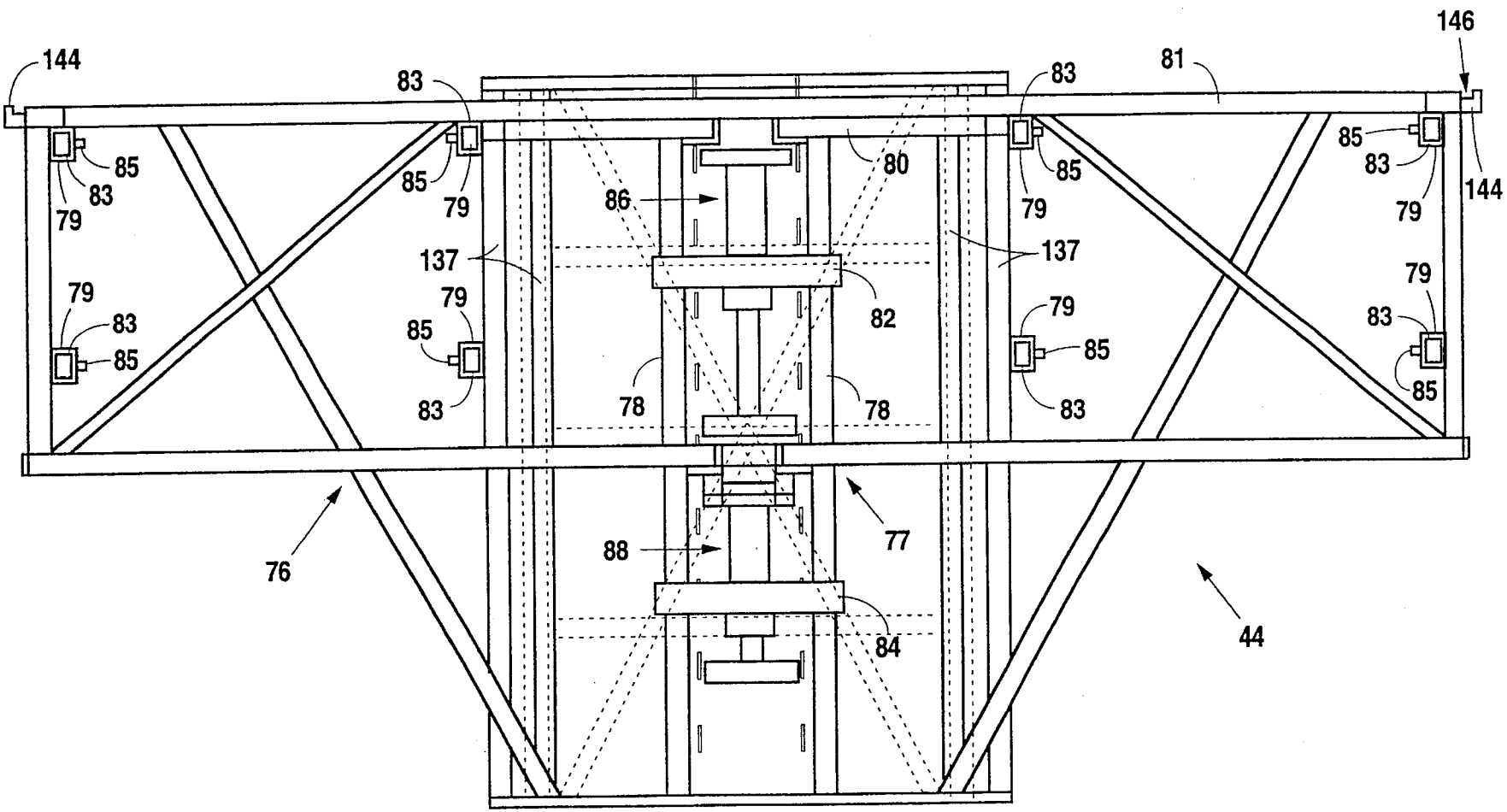
FIG. 9 is a front elevation view of the platform carriage in the preferred embodiment of the scaffold of the present invention.

Referring to FIGS. 9, 10, 11, 12, and 13, platform carriage 44 comprises a frame 76 and a yoke 77 which comprises a pair of generally vertical members 78. A plurality of sleeves 79 are connected to frame 76. A load transfer member 80 is welded to members 78 and welded to top tube 81 of frame 76. An upper skirt or brace 82 is bolted and welded to members 78 and a lower brace or skirt 84 is also bolted and welded to members 78. As illustrated in FIG. 9, a plurality of platform extension arms 83 are in telescopic engagement with sleeves 79. Arms 83 may be extended from sleeves 79 to extend the platform 42 and/or provide an extension for walkboards. Arms 83 are secured in position by keeper bolts 85, each of which extend through a sleeve 79 to abut against an arm 83.

Figure 13:
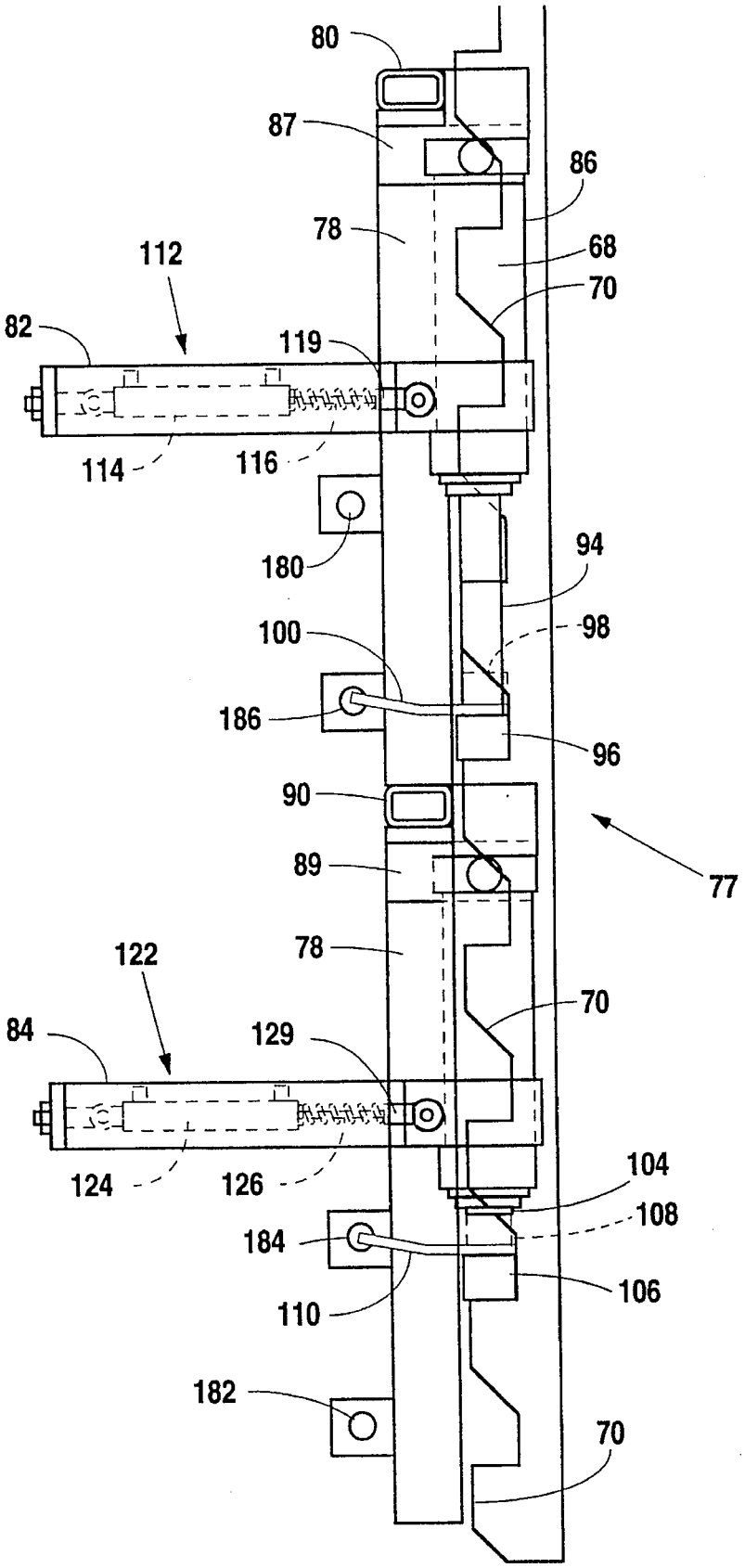
FIG. 13 is a side view of the yoke assembly.

Referring again to FIGS. 9, 10, 11, 12 and 13, platform carriage 44 further comprises a first or upper lift cylinder 86 pivotally connected to a trunion block assembly 87 which is welded to member 80. Carriage 44 further comprises a second or lower lift cylinder 88 which is pivotally connected to trunion block assembly 89. Trunion block assembly 89 is welded to cross bar 90 which is welded to frame members 78. Lift cylinder 86 comprises a cylinder body 92, a cylinder rod 94, and a cylinder boot 96 which is threadedly connected to cylinder rod 94 at a right angle thereto. As illustrated in FIG. 13, boot 96 has a threaded stub 98 which is threaded into the bottom of rod 94. Boot 96 also has a proximity reader bar 100 connected thereto. Lift cylinder 88 comprises a cylinder body 102, a cylinder rod 104, and a cylinder boot 106 which is threadedly connected to cylinder rod 104 at a right angle thereto. As illustrated in FIG. 13, boot 106 has a threaded stub 108 which is threaded into the bottom of rod 104. Boot 106 also has a proximity reader bar 110 connected thereto.

Figure 10:
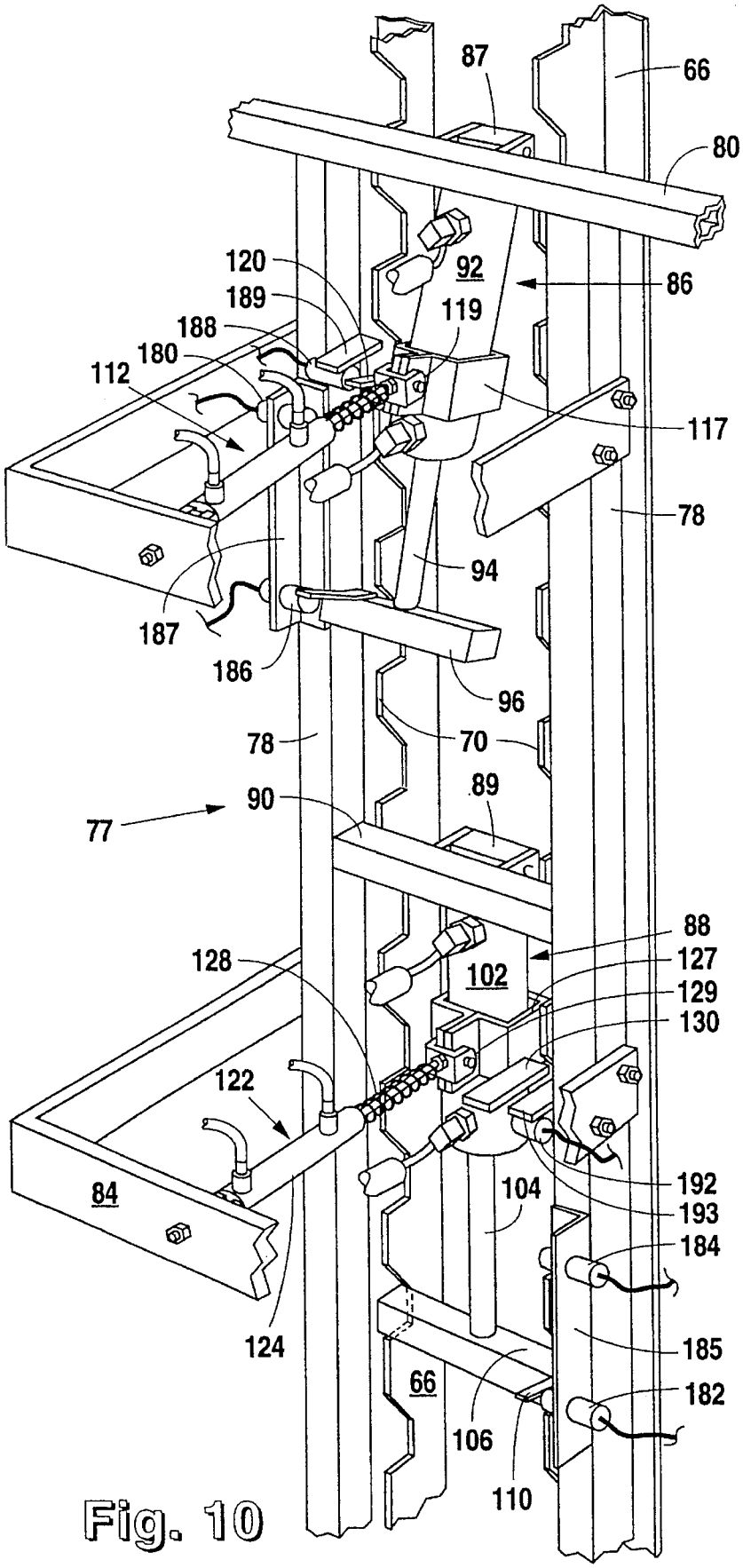
FIG. 10 is a perspective view of the yoke assembly in the preferred embodiment of the scaffold of the present invention.
Figure 11:
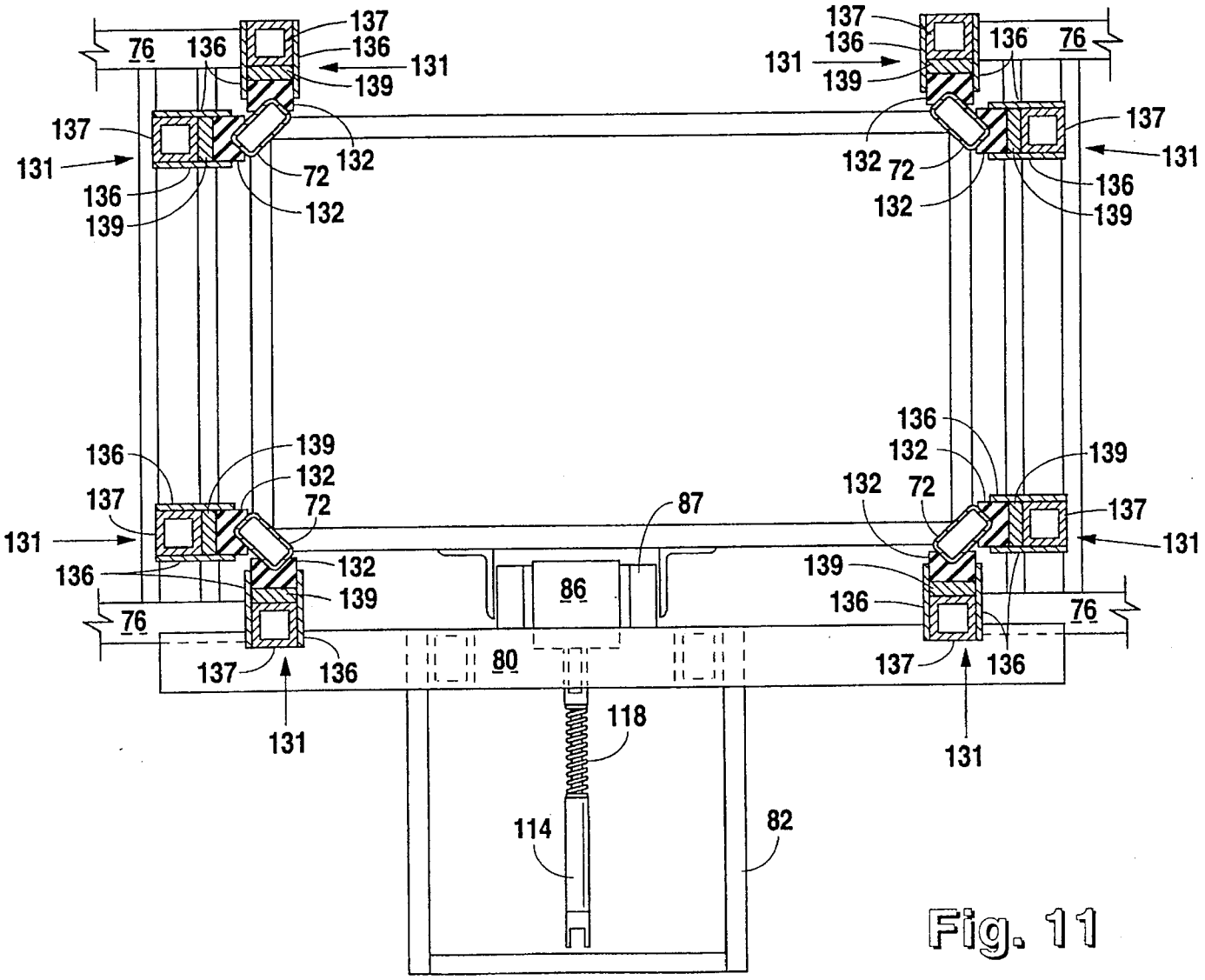
FIG. 11 is a top plan view illustrating the platform carriage mounted to a tower module.
Figure 12:
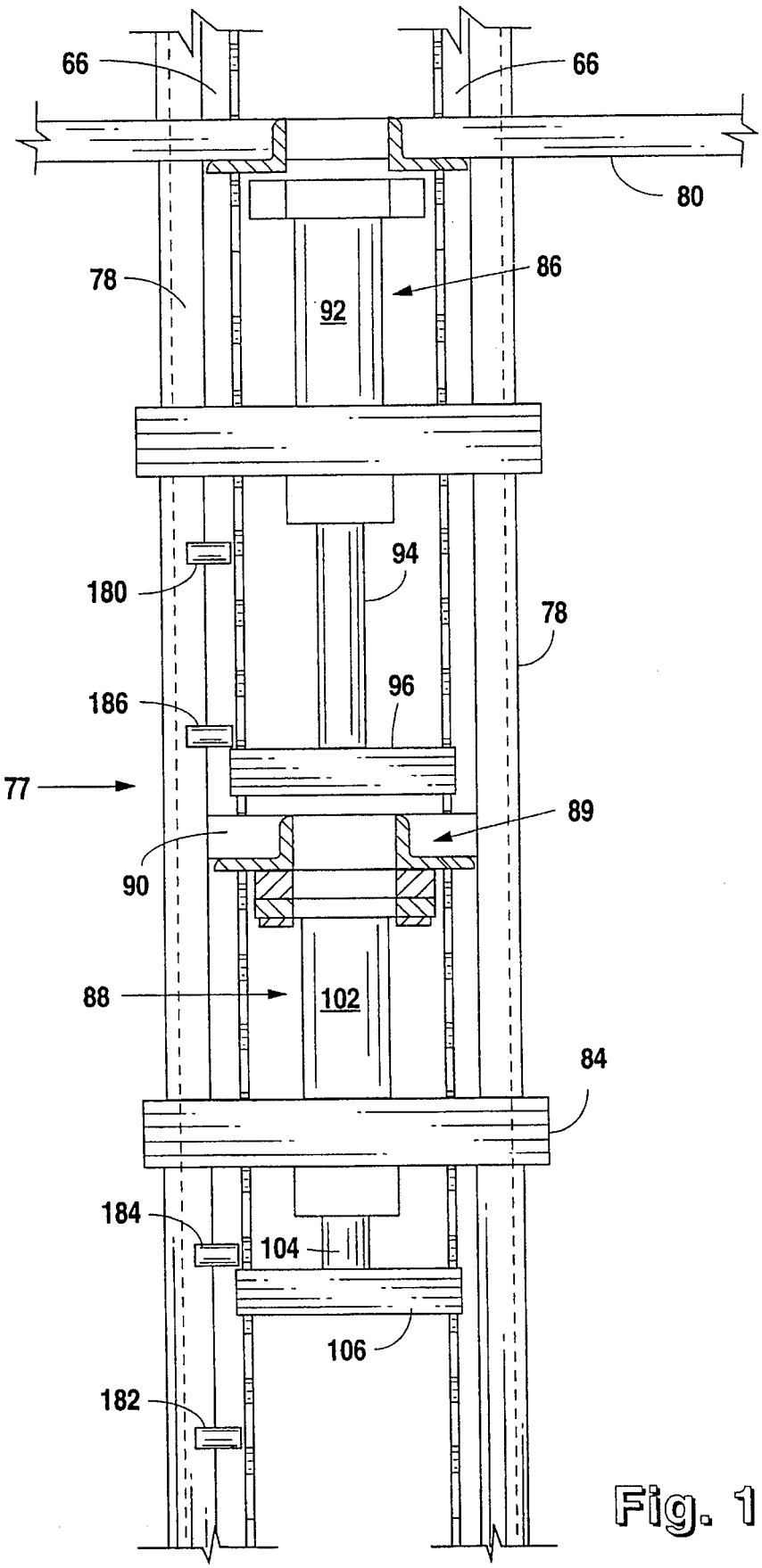
FIG. 12 is a front elevation view of the yoke assembly.

Referring to FIGS. 10, 11, and 13, yoke 77 further comprises a first or upper tilt cylinder 112 comprising a cylinder body 114 and a cylinder rod 116. Cylinder body 114 is connected to brace 82 and cylinder rod 116 is pivotally connected to a bracket 117 which is connected to lift cylinder body 92. A spring 118 is preferably positioned about rod 116 intermediate to cylinder body 114 and cleves 119 which is connected to bracket 117. A proximity reader bar 120 is welded or otherwise connected to bracket 117. Yoke 77 further comprises a second or lower tilt cylinder 122 which comprises a cylinder body 124 and a cylinder rod 126. Cylinder body 124 is connected to brace 84 and cylinder rod 126 is pivotally connected to a bracket 127 which is connected to lift cylinder body 102. A spring 128 is preferably positioned about rod 126 intermediate to cylinder body 124 and cleves 129 which is connected to bracket 127. A proximity reader bar 130 is welded or otherwise connected to bracket 127.

Figure 14:
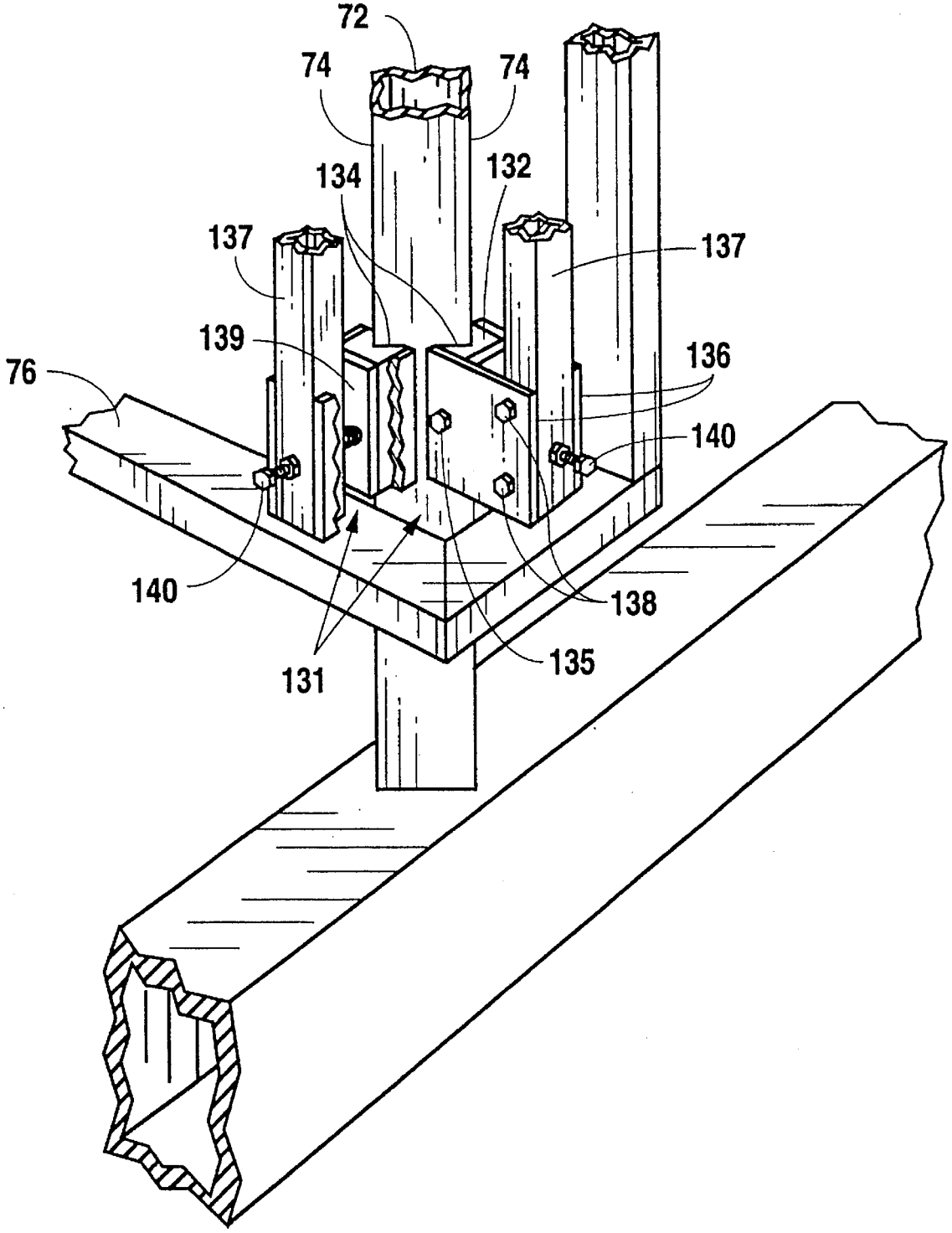
FIG. 14 is a perspective view of a lower corner section of the platform carriage illustrating a pair of friction block assemblies.

Referring to FIG. 11 and FIG. 14, platform carriage 44 is slidably engaged with tower modules 38 by eight (8) upper and eight (8) lower spring loaded friction block assemblies 131, each of which is mounted to platform carriage frame 76. Each assembly 131 comprises a composite friction block 132 of nylon impregnated with moly which has a V-shaped groove or channel 134 therein for mating and sliding engagement with tube comers 74. Each friction block 132 is held in position by a keeper bolt 135 which extends through a pair of keeper plates 136 and an oversized passage (not shown) in each friction block 132. Each pair of keeper plates 136 are secured to a carriage alignment tube 137 by a pair of anchor bolts 138. Carriage alignment tubes 137 are connected to carriage frame 76. A leaf spring 139 is positioned intermediate to each alignment tube 137 and each friction block 132 and a leaf spring adjustment bolt 140 extends through each alignment tube 137 and abuts against leaf spring 139. The coefficient of friction of the blocks 132 remains the same regardless of load on platform 42. Friction block assemblies 131 maintain the alignment of carriage 44 on tower 34.

Figure 15A:
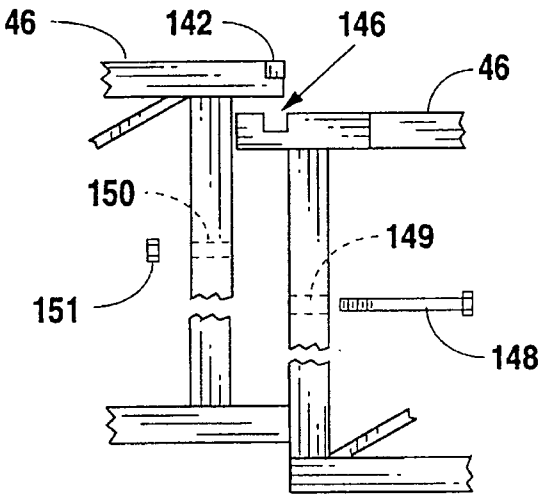
FIG. 15A is a cutaway view illustrating the connection of adjacent platform modules.
Figure 15:
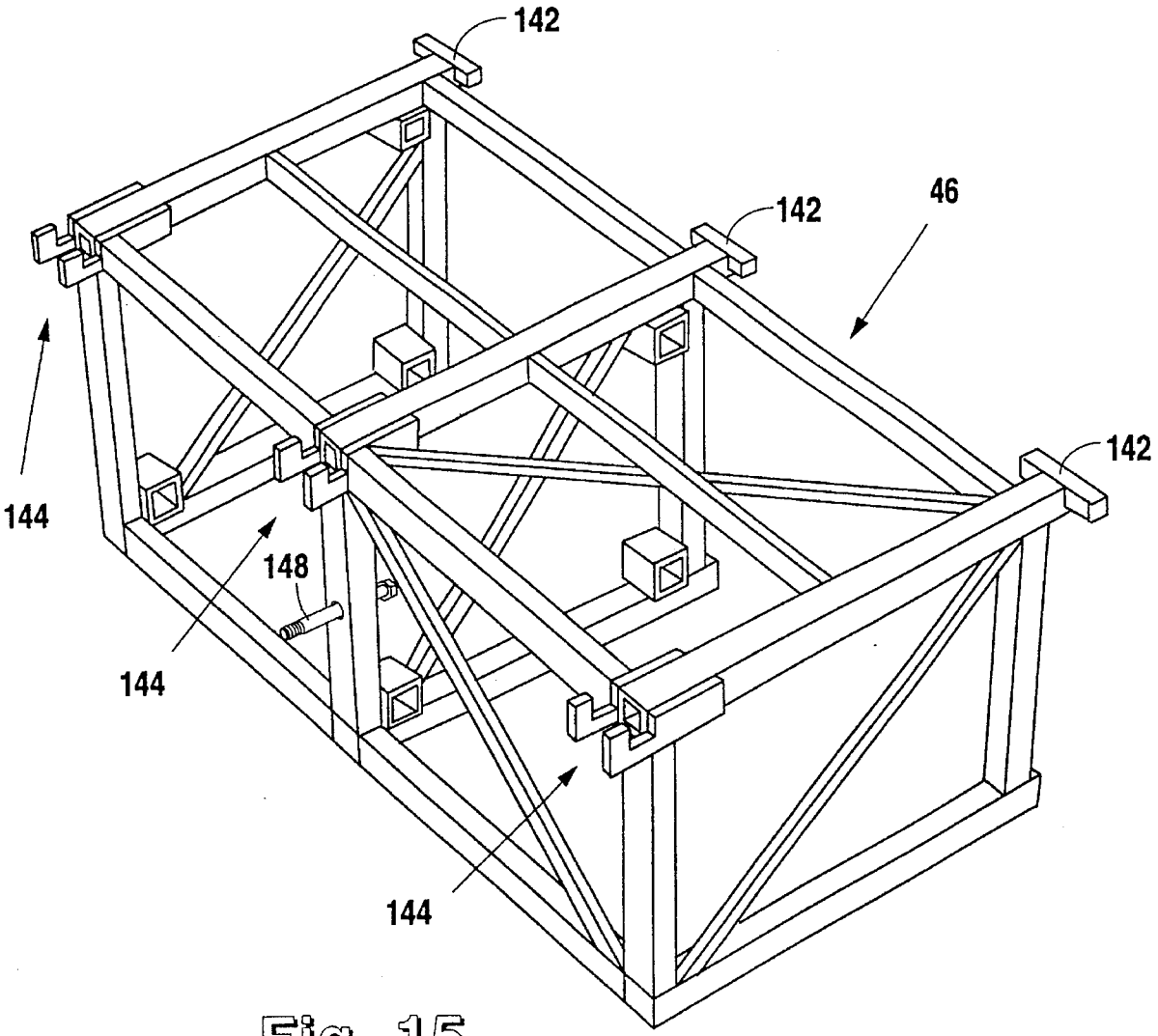
FIG. 15 is a perspective view of a platform module.
Figure 16:
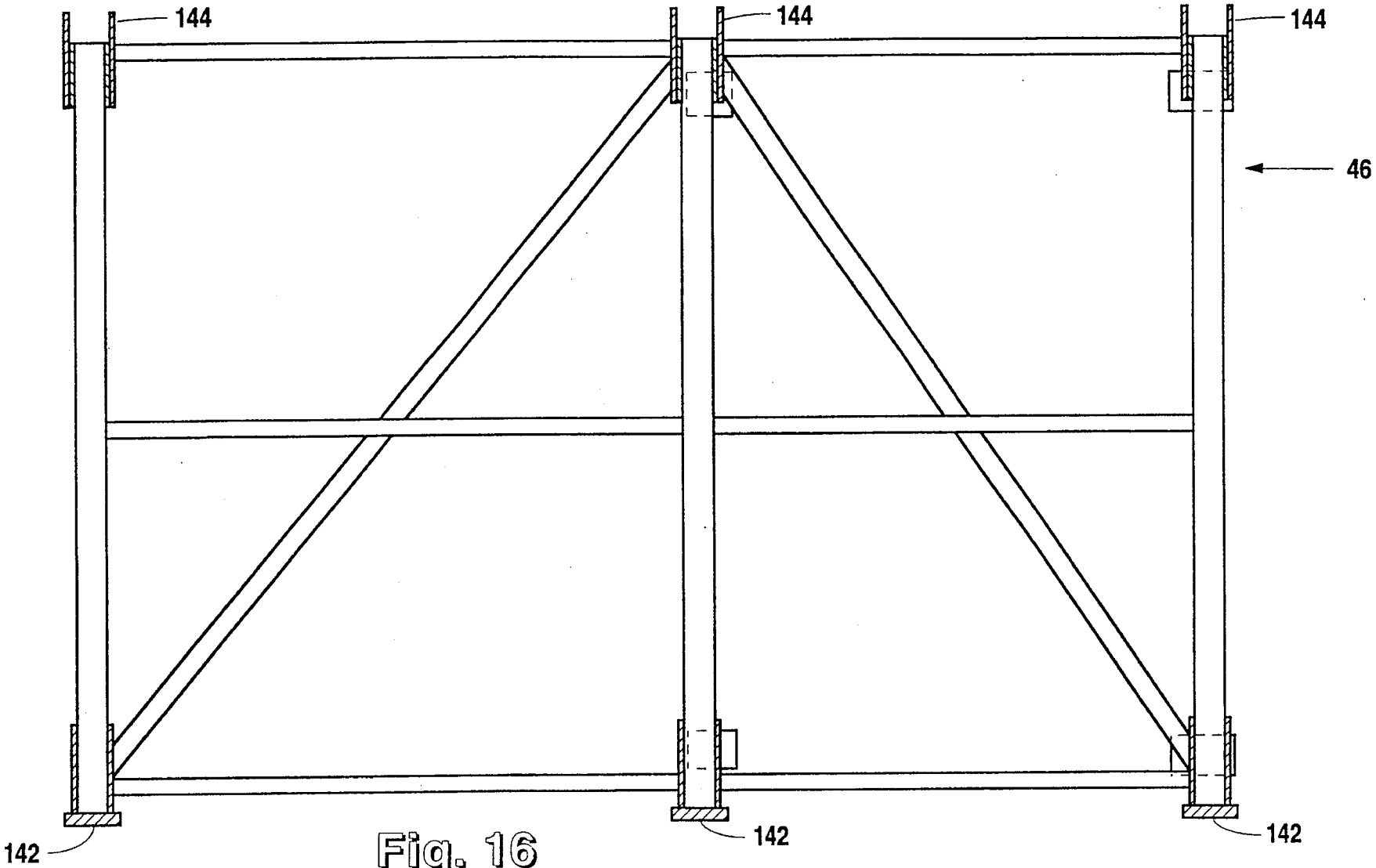
FIG. 16 is a top plan view of a platform module.
Figure 17:
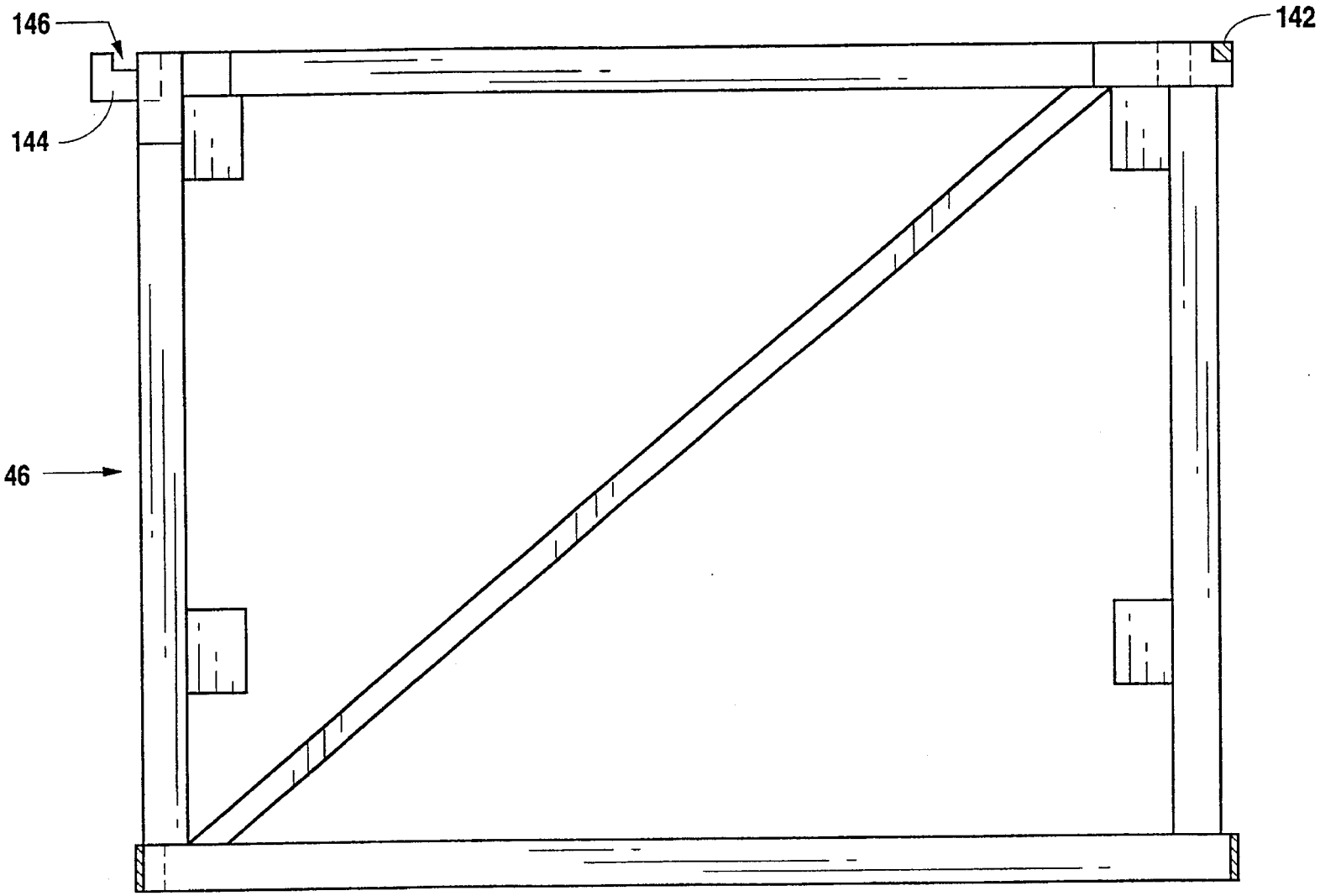
FIG. 17 is a side elevation view of a platform module.
Figure 19:
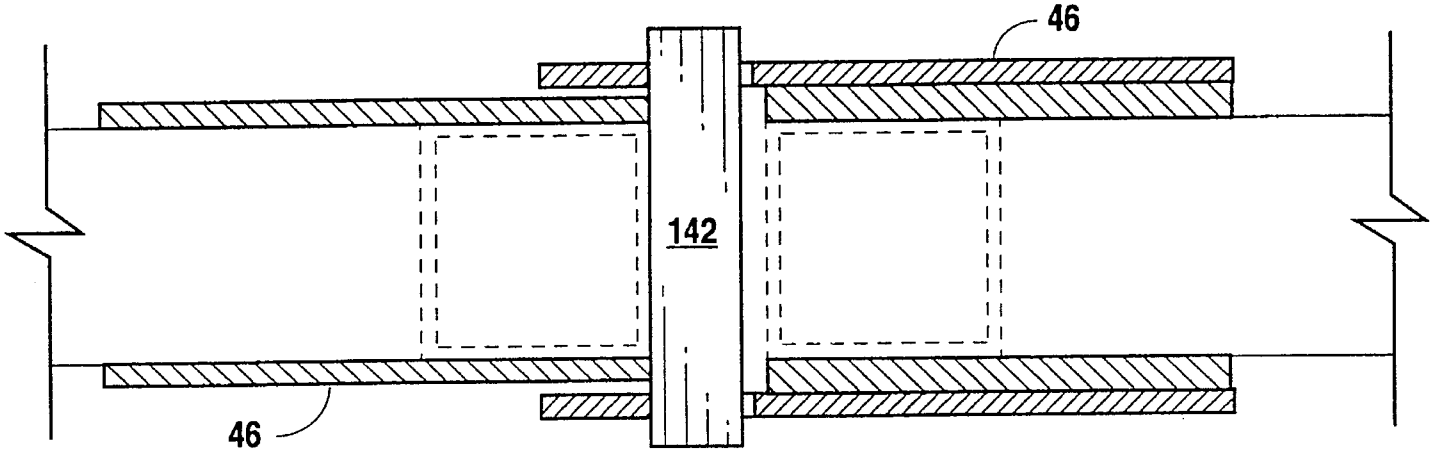
FIG. 19 is a cross sectional view illustrating the connection of adjacent platform modules.
Figure 18:
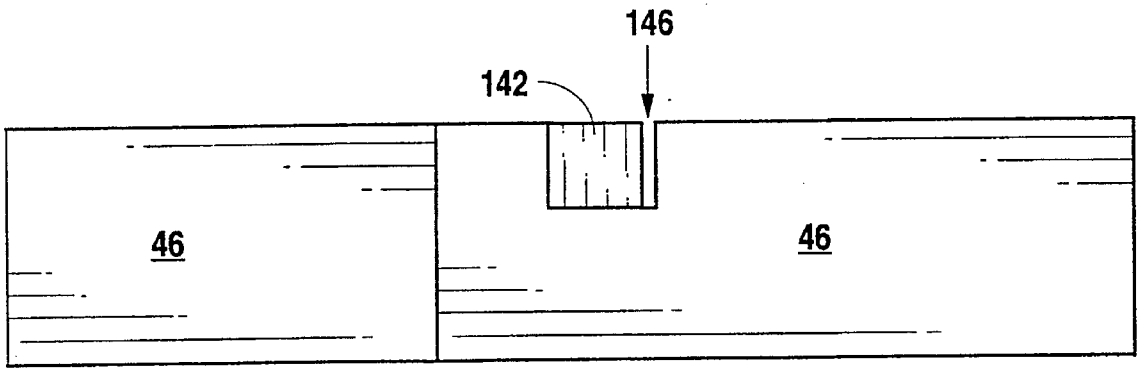
FIG. 18 is a partial view of adjoining platform modules illustrating the connection of the modules.
Figure 20:
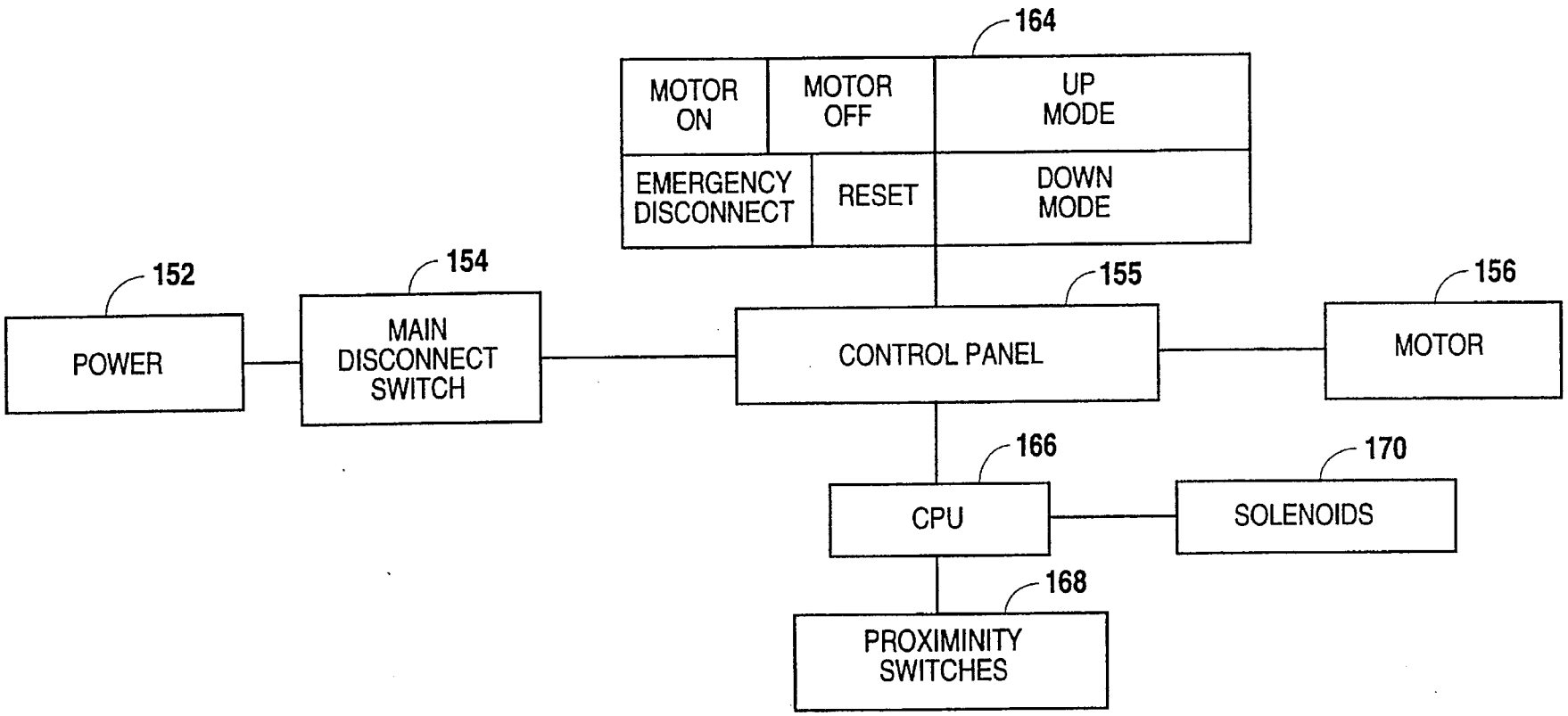
FIG. 20 is a block diagram illustrating the electrical system in the preferred embodiment of the scaffold of the present invention.

Referring to FIGS. 15, 16, 17, 18, and 19, the connection of adjacent platform modules 46 will be described in greater detail. Each platform module 46 comprises three (3) connection bars or square pins 142 and three (3) cradles 144 each having a groove or slot 146 adapted to receive the pins 142 of an adjacent module 46. As illustrated in FIG. 9, the opposite sides of platform carriage 44 likewise have a plurality of cradles 144 which define a slot 146 for receiving the pins 142 of an adjacent module 46. As illustrated in FIG. 15A, each platform module 46 is prevented from being dislodged upward and outward from the cradles 144 of an adjacent module 46 by a bolt 148 which extends through a passage 149 in a module 46 into a passage 150 in an adjacent module 46. Bolt 148 may be secured by a nut 151.

Figure 21:
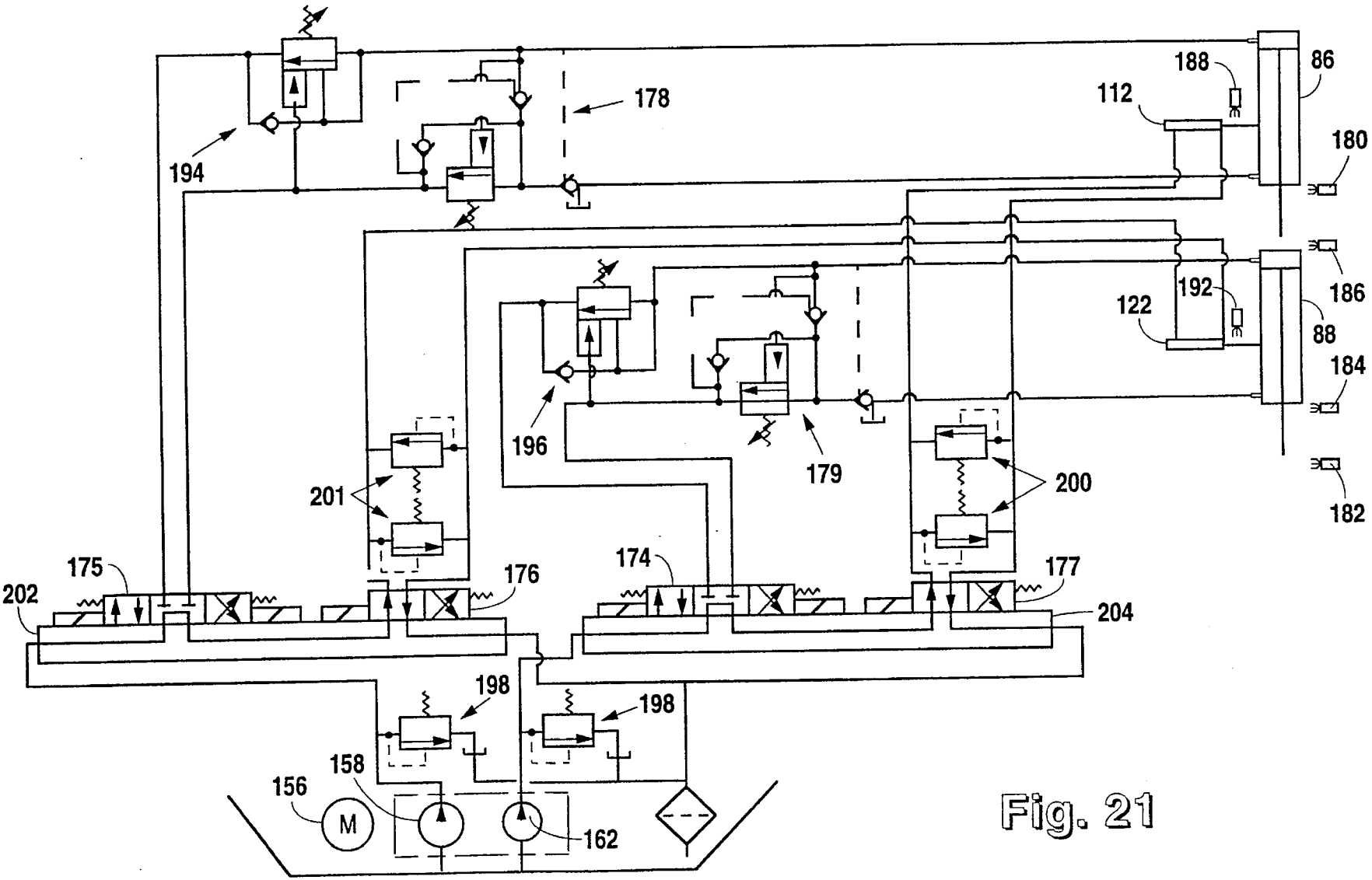
FIG. 21 is a hydraulic schematic diagram illustrating the hydraulic system in the preferred embodiment of the scaffold of the present invention.
Figures 22A, 22B, 22C, 22D, 22E, 22F, 22G:
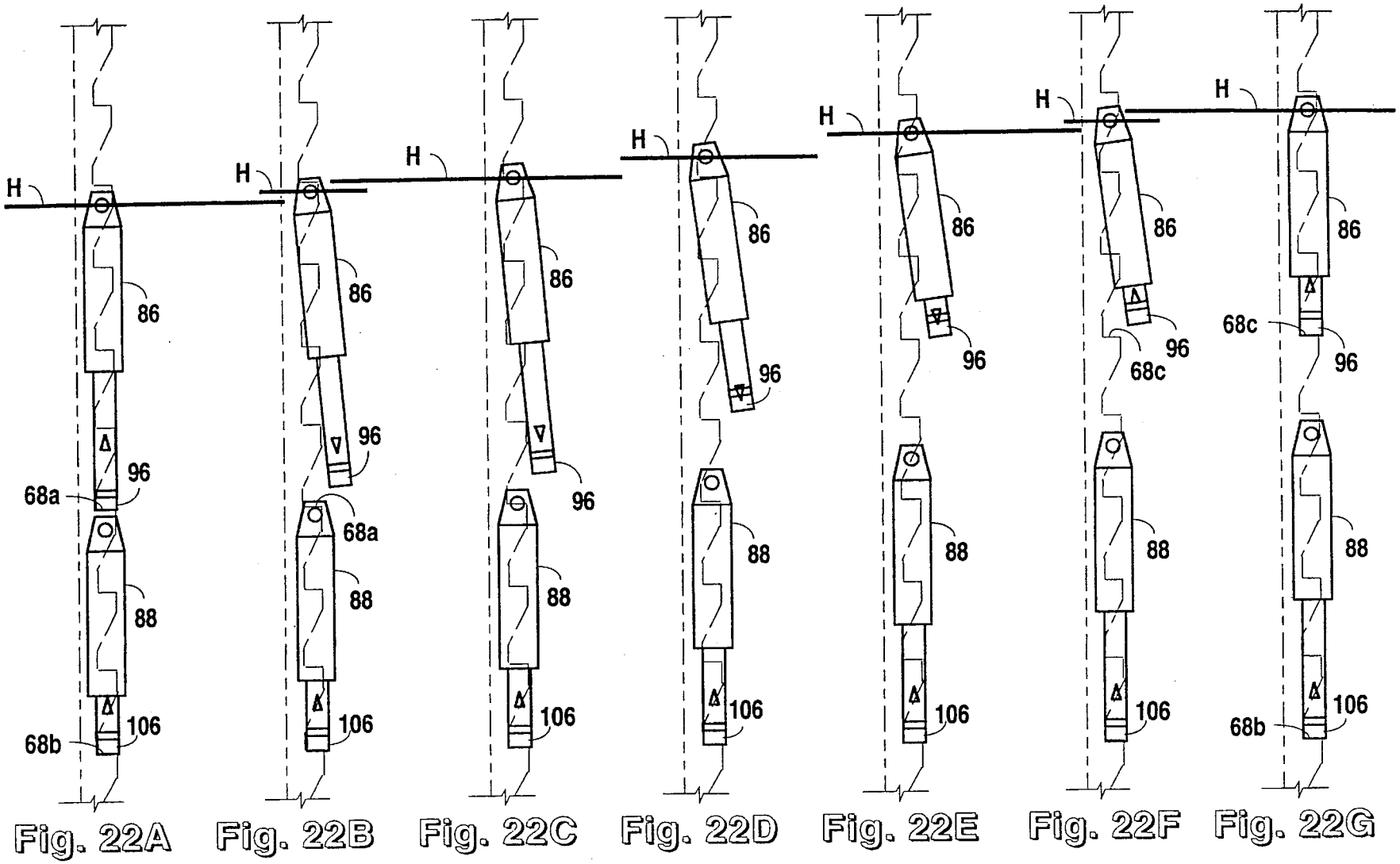
FIGS. 22A–22M are sequential side views illustrating the raising of the platform carriage in the UP MODE.

Referring to FIG. 20, FIG. 21, FIGS. 22A–22M and FIGS. 23A–23M, the operation of the scaffold 32 will be described in greater detail. FIG. 22G and FIG. 23G are repeated in the drawings for purposes of clarity in the description. Electrical power is provided to the scaffold 32 by a main power source 152 which is preferably 220 volts. The power source 152 is connected to a main disconnect switch 154 mounted in the base 36. Power flows through the main disconnect switch 154 to a control panel 155 mounted on platform 42 under deck 50 and through panel 155 to an electric pump motor 156. Motor 156 drives dual hydraulic pumps 158 and 162, as illustrated in FIG. 21. Pump 158 furnishes hydraulic oil for cylinder 86 and cylinder 122. Pump 162 furnishes hydraulic oil for cylinder 88 and cylinder 112.

Referring again to FIG. 20, control panel 155 is connected to a hand held pendant 164. Pendant 164 has a plurality of push button or toggle switches identified as MOTOR ON, MOTOR OFF, EMERGENCY DISCONNECT, RESET, UP MODE, and DOWN MODE, or with some equivalent designation. Control panel 155 is also connected to a computer or CPU 166. CPU 166 is preferably a 28K programmable controller such as the Omron SYSMAC C28K programmable controller. CPU 166 is connected to a plurality of proximity sensors or switches which are identified collectively in FIG. 20 as 168 but identified individually hereinbelow as 180, 182, 184, 186, 188, and 192. As illustrated in FIG. 10, sensors 182 and 184 are connected to a bracket 185 which is connected to member 78. Sensors 180 and 186 are connected to a bracket 187 which is connected to member 78. Sensor 188 is connected to a bracket 189 which is connected to member 78. Sensor 192 is connected to a bracket 193 which is connected to member 78. CPU 166 is also connected to a plurality of solenoids, identified collectively in FIG. 20 as 170 but identified individually hereinbelow as 174, 175, 176, and 177. Double action solenoid 174 controls cylinder 88 and double action solenoid 175 controls cylinder 86. Solenoid 176 controls cylinder 122 and solenoid 177 controls cylinder 112.

Referring to FIG. 10, FIG. 21, and FIGS. 22A–22G, the operation of the scaffold 32 typically begins with the platform carriage 44 in the PARK position with lift cylinder 86 extended and lift cylinder 88 retracted, as illustrated in FIG. 22A. The height of the platform carriage H is represented generally by the line H. In this position, boot 96 abuts against step 68*a* and boot 106 abuts against step 68*b*. CPU 166 senses the position or mode of the cylinders 86 and 88 due to proximity switches 168. When the UP MODE switch is pressed, pump 162 provides oil to cylinder 88 through valve 174 to extend cylinder 88. Simultaneously, pump 158 provides oil to cylinder 86 through valve 175 to retract cylinder 86. Cylinder 86 retracts fully (eight and one half inches (8.5")) until reader bar 100 contacts and activates proximity switch 180 and is held retracted approximately 0.25 seconds, as illustrated in FIG. 22F. Cylinder 86 thereafter reengages or drops into racks 66, begins extension in the regen mode due to regen valve 178, and overtakes cylinder 88, as illustrated in FIG. 22G. Boot 96 abuts against step 68*c* and shares the carriage load approximately 0.2 seconds, until cylinder 88 has extended fully (eight inches (8")) and proximity switch 182 contacts reader bar 110.

Figures 22G, 22H, 22I, 22J, 22K, 22L, 22M:
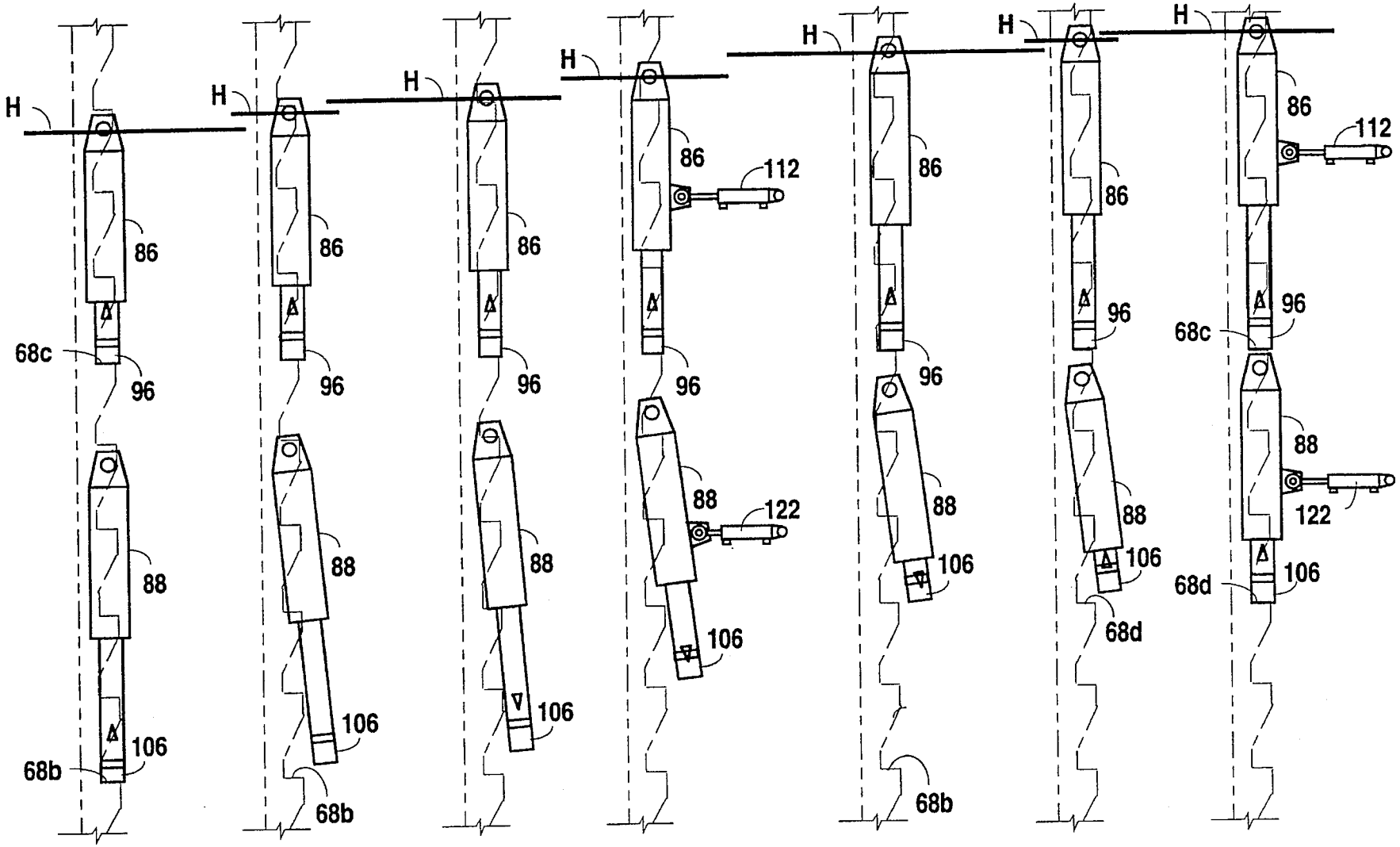
Figures 23A, 23B, 23C, 23D, 23E, 23F, 23G:
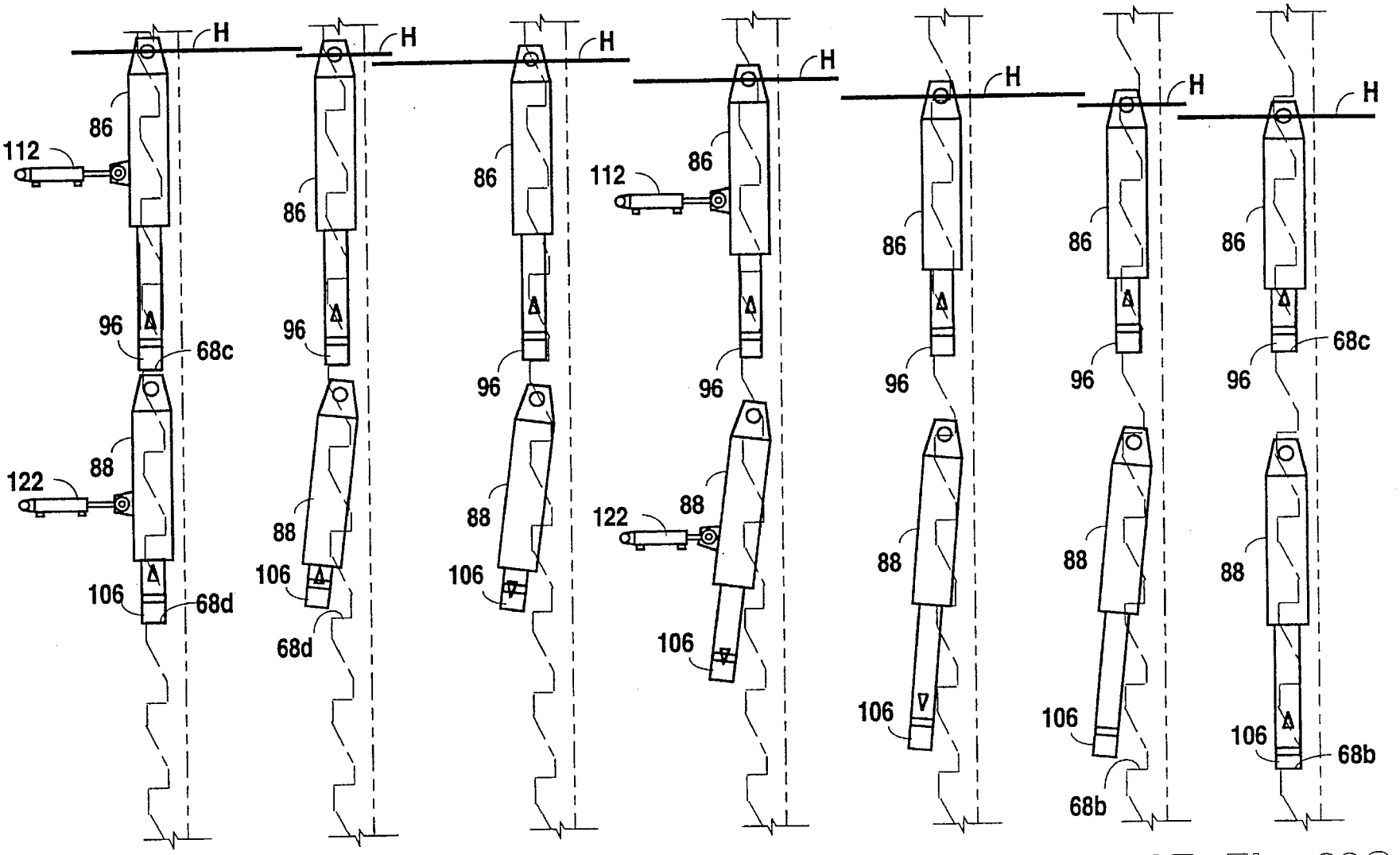
FIGS. 23A–23M are sequential side views illustrating the lowering of the platform carriage in the DOWN MODE.

Referring to FIGS. 22G–22M and continuing in the UP MODE, cylinder 88 begins retracting until reader bar 110 contacts proximity switch 184. Cylinder 86 simultaneously continues extending until proximity switch 186 contacts reader bar 100. Cylinder 88 retracts fully (8.5 inches) and is held retracted approximately 0.25 seconds after activating proximity switch 184, as illustrated in FIG. 22L. Cylinder 88 thereafter reengages or drops into racks 66 and begins extension in the regen mode due to regen valve 179. Cylinder 88 extends in the regen mode to overtake cylinder 86, such that boot 106 contacts step 68*d* and shares the load with cylinder 86 approximately 0.2 seconds until cylinder 86 has extended eight inches (8") and proximity switch 186 contacts reader bar 100. The foregoing sequential steps continue as long as the UP MODE switch is pressed and until the desired height of carriage 44 is reached along the tower racks 66.

It is to be understood that in the UP MODE, the extending lift cylinder begins retracting immediately when its respective boot reader bar contacts a lower proximity sensor upon full extension of the cylinder. Further, at such time, the other cylinder has already overtaken the extending cylinder so as to share the load of carriage 44 for approximately 0.2 seconds. It is also to be understood that in the UP MODE, tilt cylinders 112 and 122 apply a constant pressure against lift cylinders 86 and 88, respectively, of approximately one hundred (100) pounds per square inch (psi) and that springs 118 and 128 constantly bias cylinders 86 and 88, respectively, against racks 66. The foregoing condition also exists in the DOWN MODE except when the cylinders 112 and 122 are retracted. Finally, in the UP MODE, boots 96 and 106 travel along the outermost edges 70 of steps 68 before engaging their next step 68.

Referring to FIG. 10, FIG. 21, and FIGS. 23A–23G, the operation of the scaffold 32 in the DOWN MODE will be described with the height of the platform carriage 44 again being represented generally by the line H. Once again, CPU 166 senses the position or mode of cylinders 86 and 88 due to proximity switches 168. As illustrated in FIG. 23A, boot 96 abuts against step 68*c* and boot 106 abuts against step 68*d*. Upon activation of the DOWN MODE switch, cylinder 122 retracts to tilt cylinder 88 by the flow of oil from pump 158 through valve 176, thereby disengaging cylinder 88 from racks 66 and boot 106 from step 68*d*, as illustrated in FIG. 23B. Simultaneously, cylinder 86 begins retracting by the flow of oil through valve 175 and cylinder 88 begins extending in regen mode, due to regen valve 179, by the flow of oil through valve 174. When cylinder 122 retracts, reader bar 130 contacts sensor 192, thereby activating a hold relay within the CPU 166 which holds cylinder 88 in its tilted mode until cylinder 88 is fully extended, as illustrated in FIG. 23F. When fully extended, bar 110 of cylinder 88 contacts sensor 182, thereby breaking the contact on the hold relay within CPU 166 and forcing cylinder 88 against racks 66. Cylinder 86 continues to retract until boot 106 of cylinder 88 abuts against step 68*b*, as illustrated in FIG. 23G. Cylinder 86 thus continues to retract until the load is transferred to cylinder 88.

Figures 23G, 23H, 23I, 23J, 23K, 23L, 23M:
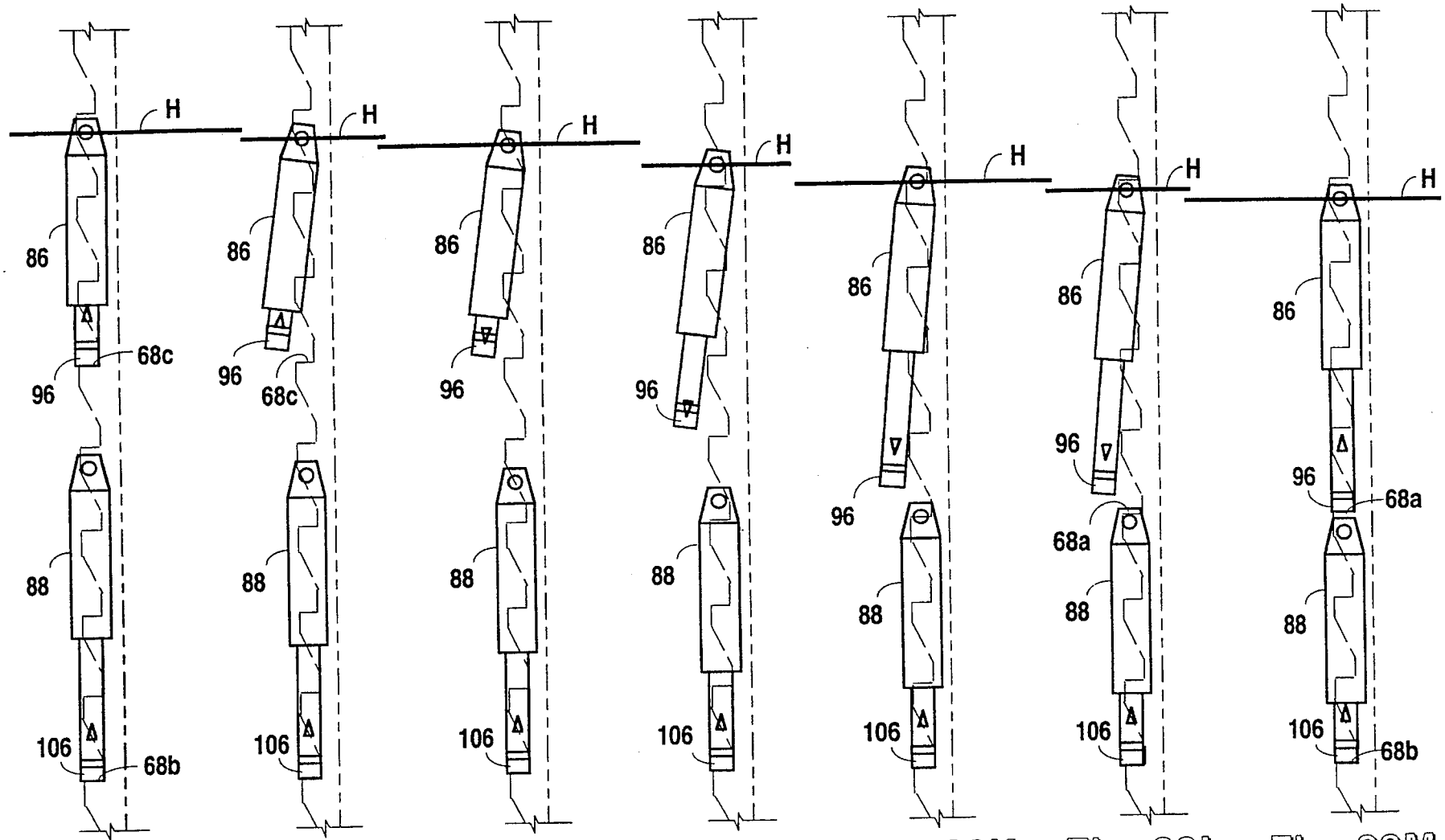

Referring to FIGS. 23G–23M and continuing in the DOWN MODE, cylinder 112 retracts to tilt cylinder 86 by the flow of oil from pump 162 through valve 177, thereby disengaging boot 96 from step 68*c*, as illustrated in FIG. 23H. Simultaneously, cylinder 88 begins retracting by the flow of oil through valve 174, and cylinder 86 begins extending in the regen mode, due to regen valve 178, by the flow of oil through valve 175. When cylinder 112 retracts, reader bar 120 contacts sensor 188, thereby activating a hold relay within the CPU 166 which holds cylinder 86 in its tilted mode until cylinder 86 is fully extended, as illustrated in FIG. 23L. When fully extended, bar 100 of cylinder 86 contacts sensor 186, thereby breaking the contact on the hold relay within CPU 166 and forcing cylinder 86 against racks 66. Cylinder 88 continues to retract until boot 96 of cylinder 86 abuts against step 68*a*, as illustrated in FIG. 23M. Cylinder 88 thus continues to retract until the load is transferred to cylinder 86. The foregoing sequential steps continue as long as the DOWN MODE switch is pressed and until carriage 44 is lowered to the desired height along the tower racks 66.

It is to be understood that the platform carriage 44 moves continuously upward along tower 34 in the UP MODE due to the combination of the speed of the cylinder that is lifting the load, the retraction speed of the cylinder that is going to take up the load, and the effect of the regen valves that cause the retraction cylinder to top out and then return at a very rapid rate overtaking the cylinder that is still under load, such that the cylinders 86 and 88 will simultaneously bear the load for approximately 0.2 seconds. Likewise, the platform carriage 44 will move continuously downward along tower 34 in the DOWN MODE due to the load transfer between cylinders 86 and 88. In the DOWN MODE, the retracting cylinder supports the load of carriage 44 while retracting eight inches (8") and until the extending cylinder has extended eight and one half inches (8.5") and takes the carriage load. The retracting cylinder continues to retract one half inch (0.5"). That is, the retracting cylinder transfers the carriage load upon retracting eight inches (8").

It is to be understood that sensors 188 and 192 sense the position of cylinders 86 and 88, respectively, when they are in the tilt mode or otherwise disengaged from steps 68. Sensors 180 and 184 sense when boots 96 and 106, respectively, are retracted. Sensors 186 and 182 sense when boots 96 and 106, respectively, are extended. CPU 166 continuously senses and monitors the position or mode of all of the cylinders.

It is to be understood that a complete UP MODE cycle lifts the platform 42 sixteen inches (16") in approximately 6.66 seconds at twelve (12) feet per minute (FPM), each step 68 having a height of eight inches (8"). Further, in the event that either lift cylinder is fully retracted, the UP MODE cycle begins with that cylinder. In all other cases, the UP MODE cycle begins with the cylinder that was under load when carriage 44 was previously stopped. Further, a complete DOWN MODE cycle lowers the platform 42 sixteen inches (16") in approximately 5.53 seconds, at 14.5 FPM. Further, when the DOWN MODE switch is pressed, the platform 42 will raise to the next PARK position (either cylinder retracted) with the retracted cylinder thereafter being disengaged from the racks 66.

Referring again to FIG. 21, the hydraulic system further comprises a counter balance valve 194 and a counter balance valve 196. Counter balance valves 194 and 196 control the speed of oil flow resulting from the load of platform 42. Further, the hydraulic system comprises a pair of system bypass valves 198, each of which is associated with one of the hydraulic pumps, thereby providing a safety bypass to prohibit the platform carriage 44 from lifting a greater load than it is capable. The hydraulic system further comprises adjustable bypass valves 200 and 201 which maintain a constant pressure of 100 psi in cylinders 112 and 122 except when cylinders 112 and 122 are retracted.

Referring again to FIG. 20, the electrical system may be summarized as follows. The primary energy source 152 provides 110 and 220 volt single phase electricity to the main disconnect circuit breaker 154. Motor 156 is a 220 volt 1800 rpm electric motor and the six (6) solenoid valves 170 are 120 volt each. Controller 166 is a 120 volt programmable controller (CPU) with 12/24 V DC input and output. The six (6) proximity sensors 168 are each 12/24 V. Control panel 155 includes a motor circuit breaker (220 V) and a 120 V circuit breaker associated with solenoids 170 and powering CPU 166. Control panel 155 also includes an electromagnetic starter with overload protection. Pendant 164 is a 12 volt pendant with six stations or push buttons, hold to raise (LIP MODE), hold to lower (DOWN MODE), reset for resetting the CPU, motor start (ON), motor stop (OFF) and emergency disconnect. The electrical system further includes a weatherproof enclosure for the main disconnect switch 154 and a weatherproof enclosure for control panel 155 and appropriate junction boxes, conduit and wiring to complete the circuitry.

Referring to FIG. 21, the hydraulic system utilized in the present invention may be summarized as follows. Electric motor 156 drives dual hydraulic pumps (158 and 162) of equal displacement. Pump 158 supplies oil for one of the hydraulic circuits and pump 162 supplies oil to the other hydraulic circuit. In each case, the respective pump takes oil from the common reservoir or tank (not shown) and supplies oil through the remainder of the hydraulic circuit consisting of hard lines, flex lines and control valves to one lift cylinder and one tilt cylinder, and returns the oil to the reservoir. In the sequence of each circuit, oil flows from the reservoir through a suction line to the pump 158 or 162 and out through a pump supply line to an adjustable system overload relief valve 198 and on to a two compartment manifold 202 or 204. Oil flows into a mounted solenoid controlled four way closed center spring return valve 175 or 174, on to either the lift cylinder circuit consisting of one regen valve and one counter balance valve and return line to the manifold, or to a solenoid controlled three way open center spring return valve 176 or 177 to two adjustable relief valves 201 and 200 to the respective tilt cylinder. Oil thereafter returns to the reservoir to complete the circuit.

It is to be understood when upper sensor 188 or 192 is activated, the respective boot 96 or 106 will not accept the load of the platform 42. Further, boots 96 and 106 will not accept the platform load until the respective sensors 188 and 192 are deactivated. Further, at least one boot 96 and 106 remains in contact with the racks 66 at all times due to the generally constant 100 psi pressure supplied by cylinders 112 and 122.

While the scaffold of the present invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

We claim:

1. A scaffold, comprising:

a tower connected to a base;

a platform engaged with said tower, said platform comprising a platform carriage adapted to be slidably engaged with said tower;

means for moving said platform relative to said tower in at least one direction up or down in a continuous motion comprising first and second spaced apart hydraulic cylinder actuators supported on said carriage and each including boot means engageable with spaced apart steps on said tower; and control means for causing one of said cylinder actuators engaged with one of said steps to move said platform relative to said tower while causing the other of said cylinder actuators to disengage from another step.

2. A scaffold, as recited in claim 1, wherein said platform carriage comprises a plurality of friction block assemblies for engagement with said tower.

3. A scaffold, as recited in claim 1, wherein said tower comprises a plurality of tower modules.

4. A scaffold, as recited in claim 1, further comprising means connected to said base for securing said base to a building or other structure with which said scaffold is being utilized.

5. A scaffold, as recited in claim 1, wherein said platform comprises a plurality of platform modules and means for releasably connecting adjacent platform modules.

6. A scaffold, comprising:

a tower connected to a base, said tower comprising a plurality of tower modules;

a platform engaged with said tower, said platform comprising a platform carriage adapted to be slidably engaged with said tower, said platform carriage comprising a plurality of friction block assemblies for engagement with said tower;

means for moving said platform up or down relative to said tower comprising a yoke assembly mounted to said platform carriage, said yoke assembly comprising first and second hydraulic cylinder assemblies each including means for systematically engaging a pair of racks connected to said tower, said racks including spaced apart steps formed thereon; and control means for actuating one of said cylinder assemblies engaged with a step to move said platform with respect to said tower and causing the other of said cylinder assemblies to disengage from another step in a predetermined manner to move said platform substantially continuously up or down relative to said tower.

7. A method for raising a scaffold platform, comprising the steps of:

(a) engaging said platform with a tower, said tower comprising a pair of racks for systematic engagement with an upper cylinder and a lower cylinder connected to said platform;

(b) engaging said lower cylinder with a first step of said racks and extending said lower cylinder while simultaneously retracting said upper cylinder;

(c) engaging said upper cylinder with a second step of said racks for a time interval while said lower cylinder is engaged with said first step and thereafter extending said upper cylinder while simultaneously retracting said lower cylinder; and (d) repeating steps (b) and (c) until said scaffold platform is raised to a desired height.

8. A method for lowering a scaffold platform, comprising the steps of:

(a) engaging said platform with a tower, said tower comprising rack means having spaced apart steps for systematic engagement with an upper cylinder and a lower cylinder connected to said platform;

(b) retracting said upper cylinder while engaged with said rack means to lower said platform;

(c) disengaging said lower cylinder from a first step and thereafter extending said lower cylinder and engaging said lower cylinder with a second step;

(d) retracting said lower cylinder while engaged with said second step to lower said platform;

(e) disengaging said upper cylinder from said rack means and thereafter extending said upper cylinder and reengaging said upper cylinder with a third step; and (f) repeating steps (b), (c), (d), and (e) until said scaffold platform is lowered to a desired height.

9. A scaffold, comprising:

a generally vertically extending tower including vertically spaced apart steps supported thereon;

a platform including a platform carriage adapted to be engaged with said tower for movement generally up and down relative to said tower;

first and second vertically spaced apart hydraulic cylinder actuators supported on said carriage, each of said actuators including boot means engageable with respective ones of said steps; and a hydraulic control circuit connected to said first and second cylinder actuators, respectively, and operable for causing said cylinder actuators to move said platform up or down with respect to said tower.

10. The scaffold set forth in claim 9 including:

means on said tower forming respective cam surfaces interposed between said steps for causing one of said cylinder actuators to pivot relative to said tower during an upward movement of said platform relative to said tower while the other of said cylinder actuators is engaged with a step and is being actuated by said control circuit to move said platform relative to said tower.

11. The scaffold set forth in claim 10 including:

means for biasing said cylinder actuators toward engagement with at least one of said steps and said cam surfaces.

12. The scaffold set forth in claim 11 wherein:

said means for biasing said cylinder actuators comprises spring means.

13. The scaffold set forth in claim 11 including:

actuator means for pivoting one of said cylinder actuators to a position out of engagement with said steps while the other of said cylinder actuators is being actuated to lower said platform relative to said tower.

* * * * *